US007759033B2

(12) United States Patent
Yagi

(10) Patent No.: US 7,759,033 B2
(45) Date of Patent: Jul. 20, 2010

(54) ELECTROPHOTOGRAPHIC PHOTORECEPTOR, PROCESS CARTRIDGE AND IMAGE FORMING DEVICE USING THE SAME

(75) Inventor: Shigeru Yagi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/707,868

(22) Filed: Feb. 20, 2007

(65) Prior Publication Data

US 2008/0075504 A1 Mar. 27, 2008

(30) Foreign Application Priority Data

Sep. 22, 2006 (JP) ..... 2006-257674

(51) Int. Cl.
*G03G 5/05* (2006.01)

(52) U.S. Cl. ..... 430/66; 430/58.1; 430/60

(58) Field of Classification Search ..... 430/60, 430/66, 58.1; 399/159
See application file for complete search history.

(56) References Cited

U.S. PATENT DOCUMENTS 4,737,429 A * 4/1988 Mort et al. ..... 430/57.5
5,834,147 A * 11/1998 Nagae et al. ..... 430/67
6,238,832 B1 5/2001 Hashizume et al.
6,372,397 B1 * 4/2002 Maruyama et al. ..... 430/59.6
2002/0051918 A1 * 5/2002 Miyamoto et al. ..... 430/58.65
2004/0057761 A1 3/2004 Ito

FOREIGN PATENT DOCUMENTS

| | | |
|---|---|---|
| CN | 1495557 A | 5/2004 |
| JP | A 2-110470 | 4/1990 |
| JP | A 11-186571 | 7/1999 |
| JP | A 2003-27238 | 1/2003 |
| JP | A 2003-29437 | 1/2003 |
| JP | A 2003-316053 | 11/2003 |

* cited by examiner

*Primary Examiner*—Mark F Huff
*Assistant Examiner*—Peter L Vajda
(74) *Attorney, Agent, or Firm*—Oliff & Berridge, PLC

(57) ABSTRACT

An electrophotographic photoreceptor comprising a photosensitive layer and a surface layer laminated on a conductive substrate in this order, wherein the surface layer contains a group 13 element and oxygen, and absorption peak intensities showing bonds other than a bond between the group 13 element and oxygen are 0.1 times or less of an absorption peak intensity showing a bond between the group 13 element and oxygen in an infrared absorption spectrum in a range of 4000 $cm^{-1}$ to 400 $cm^{-1}$, is provided.

15 Claims, 11 Drawing Sheets

ELECTROPHOTOGRAPHIC PHOTORECEPTOR, PROCESS CARTRIDGE AND IMAGE FORMING DEVICE USING THE SAME

CROSS-REFERENCE TO RELATED APPLICATION

This application is based on and claims priority under 35 USC 119 from Japanese Patent Application No. 2006-257674 filed Sep. 22, 2006.

BACKGROUND

1. Technical Field

The invention relates to an electrophotographic photoreceptor which is used in a copier, and the like, which forms an image by an electrophotographic method, as well as a process cartridge and an image forming device using the same.

2. Related Art

Recently, electrophotography is widely used for a copier, a printer, and the like. An electrophotographic photoreceptor (hereunder, also called a "photoreceptor") used for an image forming device utilizing such electrophotography is subject to various contact or stress in the device, causing deterioration. However, on the other hand, high reliability is desired together with digitalization and colorization of the image forming device.

For example, if a charging process of a photoreceptor is addressed, there are problems as follows. Firstly, in a non-contact charging method, discharged products are adhered to the photoreceptor, and image blur and the like occurs. Therefore, in order to remove the discharged products adhered to the photoreceptor, there is employed for example a system where particles having an abrasion function are mixed in developer and the discharged products are rubbed off in a cleaning section. In this case, the surface of the photoreceptor is deteriorated due to abrasion. On the other hand, recently, a contact charging method is widely used. In this method, abrasion of the photoreceptor may be also accelerated.

From such a background, a longer lifetime is desired for an electrophotographic photoreceptor. Since abrasion resistance is needed to be improved for a longer lifetime of the electrophotographic photoreceptor, the hardness of the photoreceptor surface is required to be increased.

However, in a photoreceptor comprising a hard amorphous silicon surface, discharged products are adhered, and image blur and image flow are easily generated. This phenomenon is remarkable particularly in a high-humidity environment. It is similar regarding the surface layer of an organic photoreceptor having an organic photosensitive layer.

In order to suppress the generation of such problems, a material of a carbon system is often used as the surface layer of the photoreceptor.

However, in a carbon based film such as a hydrogenated amorphous carbon (a-C:H), and a fluoridated film thereof (a-C:H, F), there is a tendency that the film is colored as the film hardness is improved. Consequently, if the surface layer comprising a carbon based film is worn by use, the transmitted light volume through the surface layer is increased with time, causing a problem of increasing the sensitivity of the photosensitive layer provided inside of the surface layer. Moreover, if the surface layer is unevenly worn in the surface direction, the sensitivity of the photosensitive layer becomes uneven. Thus there is a problem of readily causing image blur especially when forming a half tone image.

On the other hand, as a general characteristic of a carbon based thin film material, it is known that hardness improvement and transparency improvement is in a trade off relation. The reason is that, when the carbon bond in the film is addressed, it is necessary to increase the diamond type $sp^3$ bondability in order to improve the hardness. However it is inevitable that graphite type $sp^2$ bonds absorbing light are mixed in the film, and furthermore when an attempt is made to reduce the presence of the graphite type $sp^2$ bonds by adding hydrogen into the film or the like, the transparency is improved but the film property becomes organic and the hardness is decreased.

Moreover, recently research and development of a carbon nitride film has been conducted. However it has not yet reached to a hardness or a characteristic more than a conventionally known carbon based thin film such as a diamond film and a diamond like carbon film. In order to obtain a harder and more minute film, it is necessary to heat at about 1000° C. and increase the discharge power at the time of forming the film. However, such a film forming method requiring a discharge condition of high temperature and high energy, is difficult to apply to an organic photoreceptor susceptible to damage by heat or discharge, and is thus not practical.

In this manner, from the point of compatibility of the hardness and the transparency, a conventional carbon based thin film is insufficient as a surface layer of a photoreceptor. On the other hand, from this point, a hydrogenated amorphous silicon carbide film (a-SiC:H) is superior. However, since image blur and image flow easily occur due to adhesion of discharged products, it is necessary to use a drum heater in order to suppress the occurrence thereof.

Furthermore, a hydrogenated nitride semiconductor is superior in hardness and transparency but lacks moisture resistance, and is inferior in practicality under a high humidity environment.

On the other hand, in contrast to a method of forming a surface layer utilizing film-formation in the vapor phase as mentioned above, there is proposed methods of forming a surface layer by means of coating. Among these, in order to improve the abrasion resistance, it is known to use a high molecule compound having a siloxane bond for the surface layer. However, a surface layer comprising such a material is less hard compared to a surface layer formed utilizing film-formation in the vapor phase. As a result, when the photoreceptor surface is blemished or abraded with time, the surface adhesiveness is increased and the toner is adhered onto the photoreceptor surface, causing a problem of shortening the photoreceptor lifetime.

SUMMARY

According to an exemplary embodiment of the invention, there is provided an electrophotographic photoreceptor comprising a photosensitive layer and a surface layer laminated on a conductive substrate in this order, wherein the surface layer comprises a group 13 element and oxygen, and absorption peak intensities showing bonds other than a bond between the group 13 element and oxygen are 0.1 times or lower of an absorption peak intensity showing a bond between the group 13 element and oxygen, in an infrared absorption spectrum in a range of 4000 $cm^{-1}$ to 400 $cm^{-1}$.

BRIEF DESCRIPTION OF THE DRAWINGS

Exemplary embodiments of the present invention will be described in detail based on the following figures, wherein.

DETAILED DESCRIPTION

Figure 1:
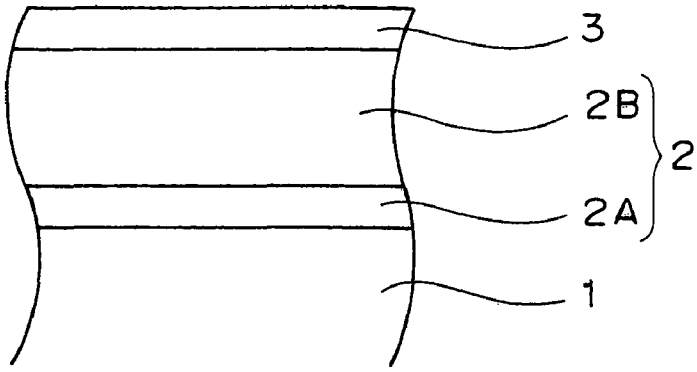
FIG. 1 is a schematic cross-section showing an example of a layer structure of a photoreceptor of an exemplary embodiment of the present invention.

The invention will be explained in detail below.

<Electrophotographic Photoreceptor>

The electrophotographic photoreceptor of the invention comprises a photosensitive layer and a surface layer laminated on an conductive substrate in this order, wherein the surface layer comprises a group 13 element and oxygen, and absorption peak intensities showing bonds other than a bond between a group 13 element and oxygen are 0.1 times or lower of an absorption peak intensity showing a bond between a group 13 element and oxygen, in an infrared absorption spectrum in a range of 4000 $cm^{-1}$ to 400 $cm^{-1}$.

A surface layer in the photoreceptor of the invention comprises a group 13 element and oxygen, and the two elements constitute a semiconductor compound excellent in a hardness and transparency. And, the outermost surface of the surface layer may be oxidized. The photoreceptor of the invention is excellent in abrasion resistance of a surface, suppresses occurrence of a scratch, and easily affords a better sensitivity. And, since at least the outermost surface comprises an oxide of a group 13 element, a photoreceptor surface itself is oxidized with difficulty under the oxidative atmosphere due to ozone, nitrogen oxide and the like generated by an electrifier and, therefore, deterioration of a photoreceptor due to oxidation may be prevented. In addition, since adhesion of discharge products on the outermost surface may be suppressed, occurrence of an image defect may be suppressed. In addition, since mechanical durability is excellent as described above, it is easy to maintain these properties at a high level over a long period of time.

In the photoreceptor of the invention, a whole surface layer may consist only of a group 13 element and oxygen and, if necessary, a surface layer may contain other elements such as hydrogen, carbon, nitrogen and the like in addition to oxygen.

Particularly, it is preferable that the surface layer contains hydrogen as the other element. In this case, due to bonding of a group 13 element and hydrogen, by compensation for a dangling bond and a structural defect, electric stability, chemical stability, and mechanical stability may afford high water repellency, and a low friction coefficient together with a high hardness and transparency.

The photoreceptor of an exemplary embodiment of the present invention is not specifically limited as long as the layer structure is such that on the conductive base substance is laminated the photosensitive layer and the surface layer in this order, and between these three layers may be provided an intermediate layer as required. Moreover, the photosensitive layer may have two layers or more, and additionally may be a function separation type. Furthermore, the photoreceptor of an exemplary embodiment of the present invention may be a so-called amorphous silicon photoreceptor where the photosensitive layer contains silicon atoms, or may be a so-called organic photoreceptor where the photosensitive layer contains organic materials such as organic polymer or the like. Hereunder is a more detailed description of specific examples of the layer structure of the photoreceptor of an exemplary embodiment of the present invention, with reference to the drawings.

FIG. 1 is a schematic cross-section showing an example of a layer structure of a photoreceptor of an exemplary embodiment of the present invention, wherein 1 denotes a conductive base substance, 2 denotes a photosensitive layer, 2A denotes a charge generation layer, 2B denotes a charge transport layer, and 3 denotes a surface layer.

The photoreceptor shown in FIG. 1 has a layer structure where on the conductive base substance 1 is laminated with the charge generation layer 2A, the charge transport layer 2B, and the surface layer 3 in this order. The photosensitive layer 2 includes two layers of the charge generation layer 2A and the charge transport layer 2B.

Figure 2:
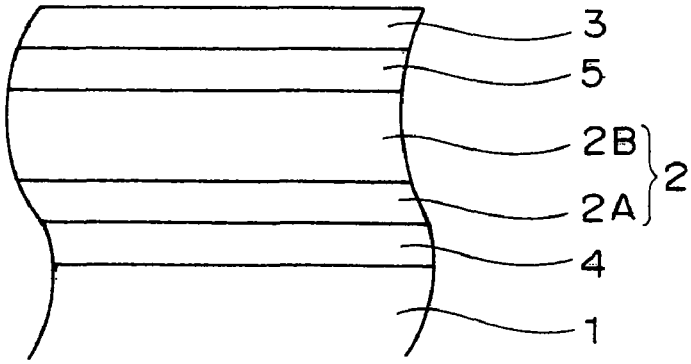
FIG. 2 is a schematic cross-section showing another example of a layer structure of the photoreceptor of an exemplary embodiment of the present invention.

FIG. 2 is a schematic cross-section showing another example of a layer structure of the photoreceptor of an exemplary embodiment of the present invention, wherein 4 denotes an under coating layer, 5 denotes an intermediate layer, and the others are the same as shown in FIG. 1.

The photoreceptor shown in FIG. 2 has a layer structure where on the conductive base substance 1 is laminated with the under coating layer 4, the charge generation layer 2A, the charge transport layer 2B, the intermediate layer 5, and the surface layer 3 in this order.

Figure 3:
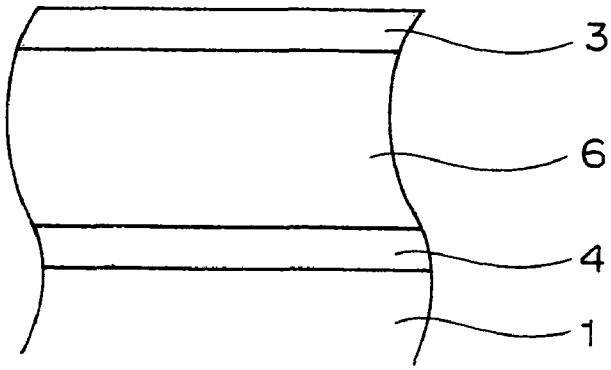
FIG. 3 is a schematic cross-section showing yet another example of a layer structure of the photoreceptor of an exemplary embodiment of the present invention.

FIG. 3 is a schematic cross-section showing an example of a layer structure of a photoreceptor of an exemplary embodiment of the present invention, wherein 6 denotes the photosensitive layer and the others are the same as shown in FIG. 1 and FIG. 2.

The photoreceptor shown in FIG. 3 has a layer structure where on the conductive base substance 1 is laminated with the under coating layer 4, the photosensitive layer 6 and the surface layer 3 in this order. The photosensitive layer 6 is a layer having integrated functions of a charge generation layer 2A and the charge transport layer 2B shown in FIG. 1 and FIG. 2.

The photosensitive layers 2 and 6 may be formed from an organic material, may be formed from inorganic material, or may be a combination thereof.

As the group 13 element contained in the surface layer 3, specifically, at least one element selected from B, Al, Ga and In may be used. Two or more elements may be contained. In this case, since elements other than In have no absorption in the visible light, a combination of contents of these atoms in the surface layer is not limited, however in the case of In, there is absorption in the visible light, it is necessary to pay attention to an image exposure wavelength for forming an electrostatic latent image of an electrophotographic system used, and a discharging exposure wavelength for discharge, and select so that these lights are not absorbed as much as possible.

In addition, it is preferable that a content of oxygen contained in the surface layer 3 exceeds 15 atomic %. When a content of oxygen is 15 atomic % or less, since a semiconductor film becomes unstable under the atmosphere containing oxygen, and a hydroxyl group is produced due to oxidation, a change in the physical property such as the electric property and the mechanical property is caused over time in some cases. In addition, an electric resistance is low, and a latent image may not be retained in some cases. From a viewpoint of maintenance of oxidation of resistance, it is preferable that a content of oxygen is larger, however a molecular bond between elements in a surface layer film is two-dimensionally arranged in many cases and therefore a film, which is insufficient in a hardness and is brittle, is obtained in some cases.

In addition, a content of oxygen in a surface layer is more preferably 28 atomic % or more, further preferably 37 atomic % or more. Practically, a content of oxygen is preferably 65 atomic % or less. A ratio of a group 13 element and oxygen is preferably 1:0.15 to 1:2.

A composition in a direction of a surface layer 3 thickness may be such that a concentration has a gradient, and may be of a multilayer structure.

For example, when the surface layer comprises a group 13 element and oxygen, an oxygen concentration may be such that a concentration distribution of oxygen in a direction of a surface layer thickness is degreased towards a photosensitive layer side of a lower layer, or a change in an element composition, or an electric resistance controlled with a third element such as a doping element is degreased towards a photosensitive layer side. In addition, when the surface layer comprises nitrogen, it is preferable that a concentration distribution of nitrogen in a direction of a surface layer thickness is increased towards a photosensitive layer side of a lower layer, and a concentration distribution of oxygen is degreased towards a photosensitive layer side of a lower layer (that is, increased towards a surface side of a photoreceptor). In this case, a nitrogen concentration or an oxygen concentration may be changed stepwisely.

When nitrogen is contained in the surface layer 3, a content of nitrogen in the surface 3 is preferably such that a ratio (x:y) of a sum x of atom numbers of a group 13 element and an atom number y of nitrogen is between 1.0:0.5 to 1.0:2.0. When the ratio is outside this range, a part forming a tetrahedron bond is small, a bond becomes ionic molecular bond, and sufficient chemical stability and hardness cannot be obtained.

Contents of a group 13 element and an element such as oxygen, nitrogen, and the like in the outermost surface of the surface layer 3 may be obtained by XPS (X-ray photoelectron spectroscopy). For example, using JPS9010MX manufactured by JEOL. Ltd., and using MgKa as a X-ray source, the surface was irradiated at 10 kV and 20 mA. Measurement of a photoelectron was performed at a step of 1 eV and, as an element amount, 3 $d_{5/2}$ was measured for a Ga element, and 1 s spectrum was measured for N and O, and an element amount was obtained from an area intensity of a spectrum, and a sensitivity factor. Before measurement, Ar ion etching was performed at 500 V for 10 seconds.

When hydrogen is contained in a surface layer 3, a content is preferably in a range of 0.1 atomic % to 30 atomic %. When hydrogen is 0.1 atomic % or less, structural disturbance remains contained in an interior of a film, and electric stability and mechanical property become insufficient. When a hydrogen is 30 atomic % or more, a probability that two or more hydrogen atoms are bound to a group 13 element and a nitrogen atom is increased, a three-dimensional structure cannot be retained, and a hardness and chemical stability, particularly, water resistance become insufficient.

The hydrogen amount may be obtained by hydrogen forward scattering (hereinafter, referred to as "HFS" in some cases) as follows.

In HFS, an accelerator (trade name: 3SDH Pelletron, manufactured by NEC), an endstation (trade name: RBS-400, manufactured by CE & A), and 3S-R10 as a system were used. For analysis, a program (trade name: HYPRA, manufactured by CE & A) was used. Measurement conditions for HFS are as follows.

He++ion beam energy: 2.275 eV

Detection angle: 160° Grazing Angle 30° with respect to incident beam

HFS measurement can pick up a signal of hydrogens which are scattered in front of a sample, by setting a detector at 30° with respect to a He++ion beam, and a sample at 75° from a normal line. In this regard, it is better to cover a detector with an aluminum foil, and remove a He atom scattered with hydrogen. Quantitation is performed by comparing hydrogen counts between a reference sample and a sample to be measured after normalization with the inhibiting ability.

As the reference sample, a sample in which H has been ion-injected into Si, and white mica are used. White mica is known to have a hydrogen concentration of about 6.5 atomic %. Quantitation of H adsorbed onto the outermost surface can be performed by subtracting an H amount adsorbed onto a clean Si surface.

A hydrogen amount in a layer may be also presumed from intensities of a group 13 element-hydrogen bond and an N—H bond by measuring an infrared absorption spectrum. When the amount is measured by an infrared absorption spectrum, a film may be formed on an infrared-transmitted substrate under the same condition as that of film forming, or a KBr tablet peeled from a photoreceptor may be measured. When a photosensitive layer is an organic photoreceptor, it may be dissolved in an organic solvent, and the residue may be used. When the photosensitive layer is amorphous silicon, a surface may be cut off, or a whole may be peeled and used.

A surface layer may contain also carbon, and a content in this case is preferably 15 atomic % or less. When a content of carbon exceeds 15 atomic %, since carbon is present as —$CH_2$ or —$CH_3$ in a surface layer film, an amount of hydrogen contained in an interior of the surface layer film is increased and, as a result, chemical stability of the surface layer film in the atmosphere is insufficient in some cases.

Contents of a group 13 element, and an element such as nitrogen, oxygen, carbon and the like in the surface layer including a distribution in a film thickness direction may be obtained by Rutherford Back Scattering (RBS) as follows.

In RBS, an accelerator (trade name: 3SDH Pelletron, manufactured by NEC), an endstation (trade name: RBS-400, manufactured by CE & A), and 3S-R10 as a system were used. For analysis, a program (trade name: HYPRA, manufactured by CE & A) was used.

Measurement conditions for RBS are such that a He++ ion beam energy is 2.275 eV, a detection angle is 160°, and a Grazing Angle is about 109° with respect to an incident beam.

Specifically, RBS is measured as follows:

First, a He++ ion beam is introduced vertically to a sample, a detector is set at 160° with respect to an ion beam, and a signal of He, which has been scattered back, is measured. From an energy and an intensity of He which have been detected, a compositional ratio and a film thickness are determined. For improving a precision of obtaining a compositional ratio and a film thickness, a spectrum may be measured at two detection angles. By measurement at two detection angles which are different in depth direction resolution and back scattering kinetic, and performing cross checking, a precision may be improved.

The number of He atoms which are scattered back by a target atom is determined by only three elements of 1) an atomic number of a target atom, 2) an energy of a He atom before scattering, and 3) a scattering angle. A density is postulated by calculation from a measured composition, and this is used to calculate a film thickness. An error of a density is within 20%.

The surface layer 3 is preferably amorphous and, further, from a viewpoint of stability and a hardness, may be amorphous containing a microcrystal, or microcrystal/polycrystal containing amorphous substance and, from a viewpoint of smoothness and friction of a surface, amorphous is preferable. A form containing a microcrystal in an amorphous substance is preferable from a viewpoint of stability and smoothness. Crystalline/amorphous may be determined by the presence or the absence of a dot or a line in a diffraction image obtained by RHEED (Reflection High-Energy Electron Diffraction) measurement. A diffraction image in which a vague line is observed in a halo image may be used.

For controlling an electrical conductivity type, various dopants may be added to the surface layer. When electrical conductivity is controlled to an n type, for example, one or more elements selected from C, Si, Ge and Sn may be used and, when electrical conductivity is controlled to a p type, for example, one or more elements selected from Be, Mg, Ca, Zn and Sr may be used.

There is a tendency that the surface layer 3 contains a bonding defect in its interior structure or a grain boundary in the case of amorphous or microcrystal. For this reason, in order to inactivate the defect, the surface layer may contain hydrogen and/or halogen element. Hydrogen or a halogen element in the surface layer has the function of electrical compensation by being taken into the bonding defect, and eliminating reaction active sites. For this reason, since trapping associated with diffusion and transference of carriers in the surface layer is suppressed, a rise in a remaining potential due to interior accumulation of a charge when electrification and light exposure are repeated, and the electrification property of a photoreceptor surface may be more stabilized.

As described above, the surface layer 3 in the invention may contain various elements in addition to a group 13 element and oxygen, and it is necessary that all absorption peak intensities showing bonds other than a bond between a group 13 element and oxygen are 0.1 times or less of an absorption peak intensity showing a bond between a group 13 element and oxygen, in an infrared absorption spectrum in a range of 4000 $cm^{-1}$ to 400 $cm^{-1}$. That is, by realizing the state where there is little bonds other than a bond between a group 13 element and oxygen in the surface layer, for example, even when allowed to stand under the high temperature high humidity environment, or further even when repeatedly used under the oxidative atmosphere in an electrophotographic device, chemical stability may be maintained, and occurrence of image blurring may be avoided.

Figure 10:
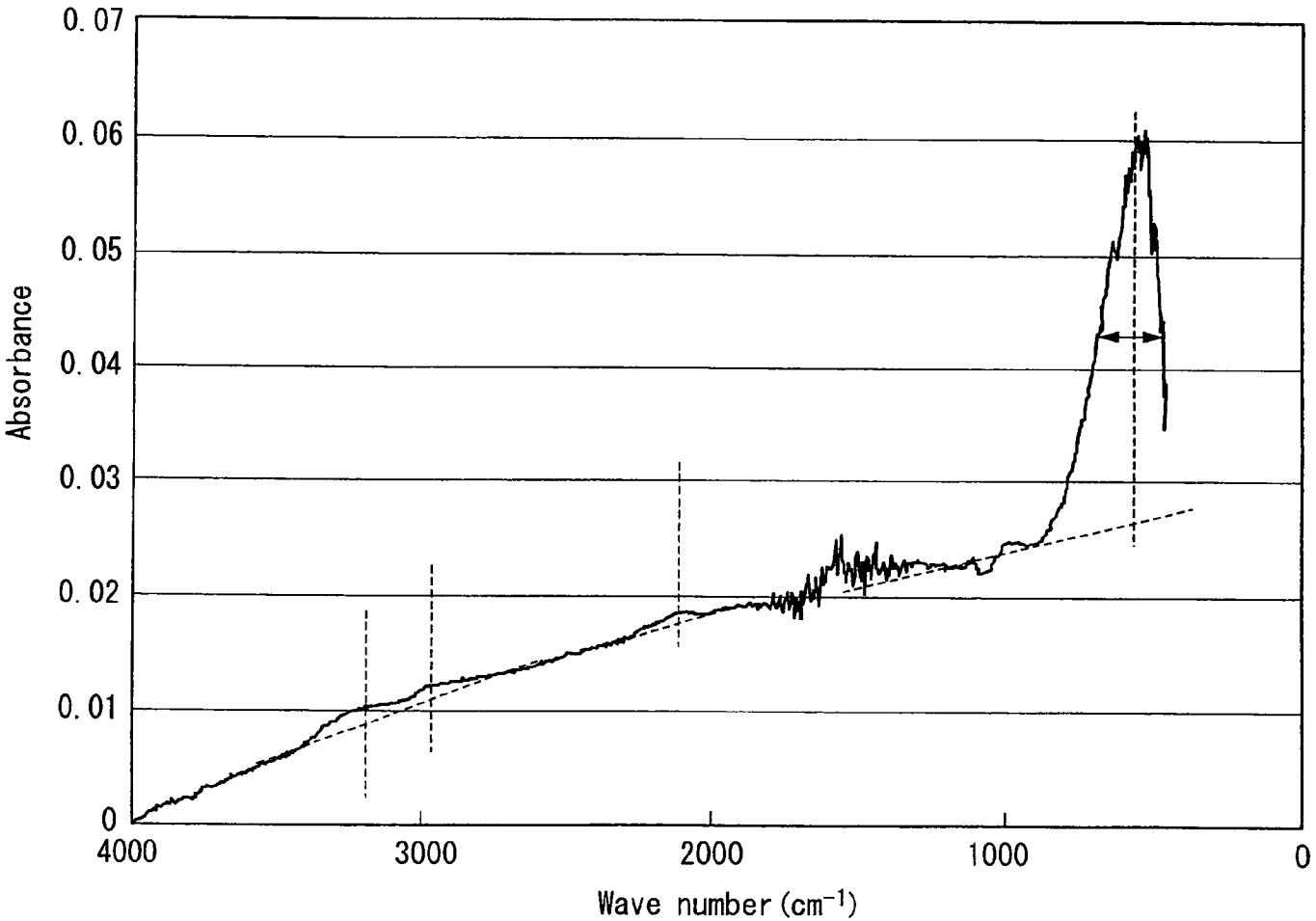
FIG. 10 is a view showing an IR spectrum of a surface layer film prepared in Example 3.

A relationship between the absorption peak intensities in an infrared absorption spectrum will be explained by explaining a specific example. FIG. 10 is a spectrum view showing an infrared absorption spectrum (hereinafter, referred to as "IR spectrum" in some cases) of a surface layer prepared in Example 3 described later. Since gallium is used as a group 13 element herein, according to this spectrum, there are an absorption peak due to stretching vibration of N—H near 3230 $cm^{-1}$, and an absorption peak due to stretching vibration of Ga—H near 2100 $cm^{-1}$. Further, there is an absorption peak due to stretching vibration of C—H near 2950 $cm^{-1}$. And, there is an absorption peak due to skeleton vibration of Ga—O near 520 $cm^{-1}$.

In this case, the fact that all of the absorption peak intensities showing bonds other than a bond between the group 13 element and oxygen are 0.1 times or less of an absorption peak intensity showing a bond between the group 13 element and oxygen means that intensity ratios ($I_{Ga—H}/I_{Ga—O}$, $I_{N—H}/I_{Ga—O}$, $I_{C—H}/I_{Ga—O}$) of an absorption peak intensity ($I_{Ga—H}$) showing a bond between Ga and hydrogen, an absorption peak intensity ($I_{N—H}$) showing a bond between nitrogen and hydrogen (NH), and an absorption peak intensity ($I_{C—H}$) showing a bond between carbon and hydrogen with respect to an absorption peak intensity ($I_{Ga—O}$) due to a bond between Ga which is a group 13 element, and oxygen O are 0.1 or less, respectively.

When the intensity ratios become larger than 0.1, it becomes impossible to neglect contribution of bonds other than a bond between Ga and oxygen on a photoreceptor surface and, by exposing to the oxidative atmosphere, stability of the photoreceptor property is deteriorated.

Specifically, an electrophotographic photoreceptor is exposed to steps such as oxidation and ion bombardment with a corona electrifier including corotron charging and roll charging during its image forming process. In addition, by water adsorption and adsorption of discharge products under the high temperature high humidity environment, a surface is exposed to an acid such as a nitric acid compound, or an alkali such as an ammonium salt. For this reason, for example, when the intensity ratios $I_{Ga—H}/I_{Ga—O}$, $I_{N—H}/I_{Ga—O}$, $I_{C—H}/I_{Ga—O}$ are larger than 0.1, respectively, a reaction on a hydroxy group, a NOH group or a COOH group occurs, water-soluble discharge products are adsorbed and, in particular, under the high temperature high humidity (30° C., 80% RH) environment, electrical conductivity is generated, and image deletion is generated. In addition, when $I_{C—H}/I_{Ga—O}$ is larger than 0.1, stability of a film over time becomes insufficient.

All of the absorption peak intensities showing bonds other than a bond between the group 13 element and oxygen are preferably 0.08 times or less (the intensity ratios are 0.08 or less), more preferably 0.05 times or less (the intensity ratios are 0.05 or less).

And, ideally, it is desirable that an intensity ratio is 0 at a measurement limit of an IR spectrum.

In the invention, the absorption peak intensity means a magnitude of an absorption peak (absorbance), and each absorption peak intensity in FIG. 10 refers to a maximum magnitude in a vertical direction of each absorption peak obtained by adopting a dotted line as a base line in the figure.

In this case, an absorption peak intensity due to a bond between Ga and oxygen ($I_{Ga—O}$) is increased or degreased depending on a film thickness and uniformity of a bond between mutual elements. And, absorptions of an absorption peak intensity due to a bond between Ga and hydrogen ($I_{Ga—H}$), an absorption peak intensity due to a bond between nitrogen and hydrogen ($I_{N—H}$), and an absorption peak intensity due to a bond between carbon and hydrogen ($I_{C—H}$) are proportional to an amount of a hydrogen bound to an element in a film. In addition, there is a tendency that an amount of hydrogen in the surface layer in the invention is larger as compared with an amount of binding hydrogen in a film, that is, an amount of hydrogen presumed from an infrared absorption spectrum. Presumption of an amount of hydrogen with an IR spectrum may be obtained by producing a calibration line between a measured value such as HFS, and an absorption intensity.

In the invention, a full width at half maximum of an absorption peak of a group 13 element and oxygen (arrow in FIG. 10) is preferably 300 $cm^{-1}$ or less. A full width at half maximum is a line width at a height which is a half of a peak intensity. When the full width at half maximum is larger than 300 $cm^{-1}$, a bond between a group 13 element and oxygen becomes too irregular, and the photoreceptor becomes unstable to water or oxidation in some cases.

In the invention, an infrared absorption spectrum may be measured using a sample which has been made into a film on a substrate for an infrared absorption spectrum simultaneously with, or under the same condition as the condition for forming a surface layer of an electrophotographic photoreceptor. Particularly, from a viewpoint of a hardness and easy handling, a crystalline Si substrate may be used. Of course, when a photoreceptor on which a surface layer is provided may be excised into a measurement sample, an infrared absorption spectrum may be measured using a photoreceptor itself.

For measuring an infrared absorption spectrum, a Fourier transformation infrared absorption measuring device system B (trade name: Spectrum One, manufactured by Perkin Elmer) having an S/N ratio of 30000:1 and resolution of 4 $cm^{-1}$ was used. The sample which had been film-formed on a crystalline Si substrate was measured after mounting on a sample base equipped with a beam condenser. As a reference, a silicon wafer, which had not been film-formed, was used.

In addition, for example, as a full width at half maximum of GaO absorption, a straight line obtained by connecting a shoulder or a valley of absorption from 900 $cm^{-1}$ to 1000 $cm^{-1}$ and a flat part at 1300 $cm^{-1}$ to extrapolate on a low wave number side was adopted as a baseline, absorption from an intersection with a line vertically drawn from a GaO absorption peak (summit) to a summit of the peak was adopted as a total absorption intensity, and a line width in a transverse direction of adsorption at a position at an intensity which is half of this total absorption intensity was defined as a full width at half maximum.

Then, preferable properties of a surface layer 3 other than the aforementioned composition will be briefly explained.

The surface layer 3 may be either of amorphous or crystalline as described above, and in order to enhance adherability with a photosensitive layer (or intermediate layer) and, make sliding of a photoreceptor surface better, the surface layer is preferably amorphous. Alternatively, a lower layer (photosensitive layer side) of the surface layer may be microcrystalline, and an upper layer (photoreceptor surface side) may be amorphous.

The surface layer 3 may be such that a charge is injected therein at electrification. In this case, it is necessary that a charge is trapped at an interface between the surface layer 3 and a photosensitive layer. Alternatively, a charge may be trapped on a surface of the surface layer 3. For example, in the case where the photosensitive layer is a function separation type as shown in FIGS. 1, 2, when an electron is injected into a surface layer by negative electrification, a surface on a surface layer side of a charge transport layer may perform the function of charge trapping, or for arresting injection of a charge, and trapping a charge, an intermediate layer may be provided between a charge transport layer and a surface layer. Also in the case of positive electrification, the same may apply.

A thickness of the surface layer 3 is preferably in a range of 0.05 μm to 3 μm. When the thickness is less than 0.05 μm, a surface layer easily undergoes influence of a photosensitive layer, and has an insufficient mechanical strength in some cases. On the other hand, when the thickness exceeds 3 μm, by repeating electrification and light exposure, a remaining potential is raised, or a mechanical internal stress to a photosensitive layer is increased, and peeling or cracking is easily generated in some cases.

And, the surface layer 3 may have both of the function as a charge injection arresting layer, and the function as a charge injection layer. In this case, by adjusting an electrical conductivity type of the surface layer 3 to an n type or a p type as described above, the surface layer may function as a charge injection arresting layer and a charge injection layer. As an intermediate layer, a layer having a lower resistance than that of the surface layer may be used. It is preferable that this intermediate layer also has the same relationship of an absorption peak as that of the surface layer.

When the surface layer 3 functions also as an electron injection layer, a charge is trapped on a surface (surface on surface layer side) of an intermediate layer or a photosensitive layer. In the case of negative electrification, an n-type surface layer functions as an electron injection layer, and a p-type surface layer functions as a charge injection arresting layer. In the case of positive electrification, an n-type surface layer functions as an charge injection arresting layer, and a p-type surface layer functions as a charge injection layer.

(Formation of Surface Layer)

Then, a method of forming a surface layer will be explained. Upon formation of the surface layer, the known vapor phase film forming method such as a plasma CVD (chemical vapor deposition) method, a metal-organic chemical vapor deposition method, a molecular beam epitaxy method and the like may be utilized. In addition, a surface oxidizing method may be also utilized. In this case, the surface layer may be formed so that a group 13 element and oxygen are directly contained on a photosensitive layer. Alternatively, a photosensitive layer may be cleaned with a plasma.

Then, embodiments will be explained referring to drawings of devices used in forming the surface layer.

Figure 4A:
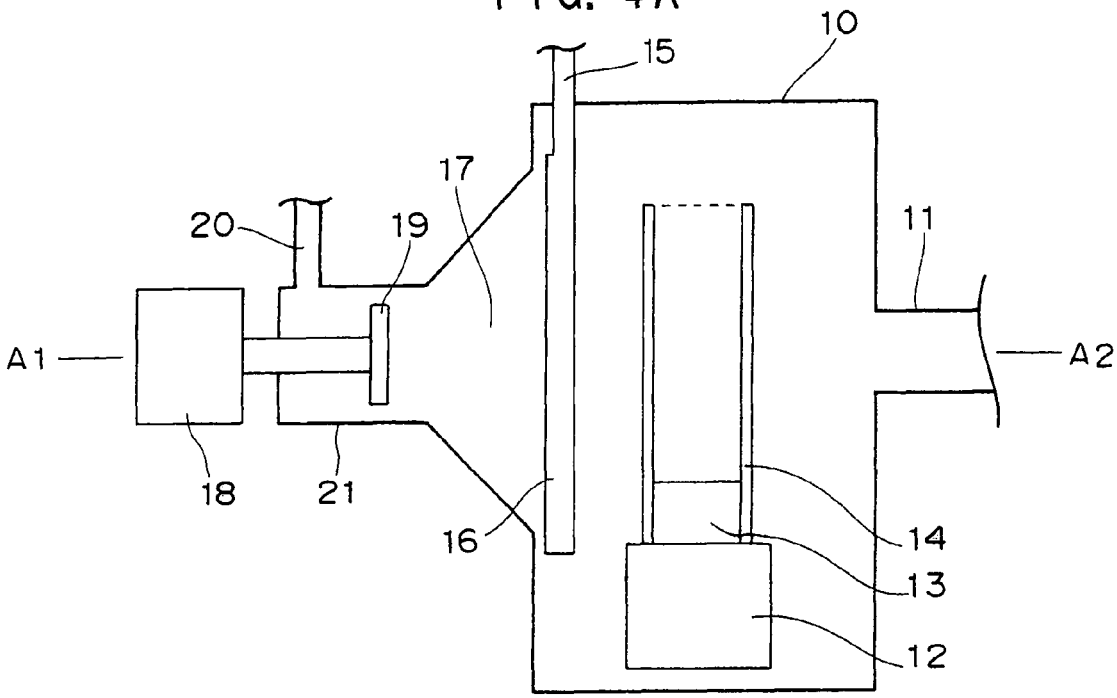
FIG. 4A and FIG. 4B are schematic diagrams showing an example of a film-forming apparatus used for forming the surface layer of the photoreceptor of an exemplary embodiment of the present invention.
Figure 4B:
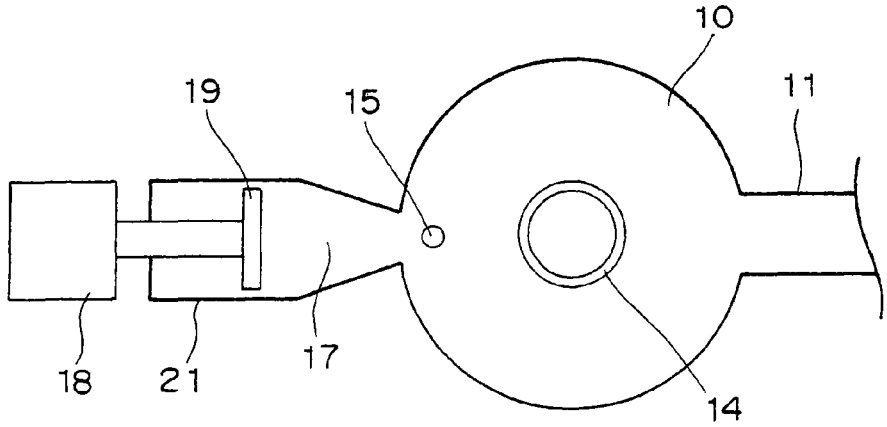

FIGS. 4A and 4B are schematic diagrams showing one example of a film forming device used in forming a surface layer of the photoreceptor of the invention, FIG. 4A represents a schematic cross-sectional view when the film forming device is observed from a side surface, and FIG. 4B represents a schematic cross-sectional view between A1-A2 of the film forming device shown in FIG. 4A. In FIGS. 4A and 4B, 10 is a film forming chamber, 11 is an exhaust port, 12 is a base rotation part, 13 is a base holder, 14 is a substrate, 15 is a gas introducing part, 16 is a shower nozzle having an opening through which a gas introduced from the gas introducing part 15 is ejected, 17 is a plasma diffusing part, 18 is a high frequency power supplying part, 19 is a plate electrode, 20 is a gas inlet, and 21 is a high-frequency discharge tube part.

In the film forming device shown in FIGS. 4A and 4B, an exhaust port 11 connected to a vacuum exhaust device not shown is provided at one end of the film forming chamber 10, and a plasma generating device composed of the high frequency power supplying part 18, the plate electrode 19 and the high frequency discharge tube part 21 is provided on a side opposite to a side on which the exhaust port 11 of the film forming chamber 10 is provided.

This plasma generating device is composed of the high frequency discharge tube part 21, the plate electrode 19 which is arranged in the high frequency discharge tube part 21 and in which a discharge surface is provided on the exhaust part 11 side, and the high frequency power supplying part 18 which is arranged outside the high frequency discharge tube part 21, and is connected to a surface on a side opposite to the discharge surface of the plate electrode 19. In addition, the gas inlet 20 for supplying a gas into the high frequency discharge tube part 21 is connected to the high frequency discharge tube part 21, and another end of this gas inlet 20 is connected to a first gas supplying source not shown.

Figure 5:
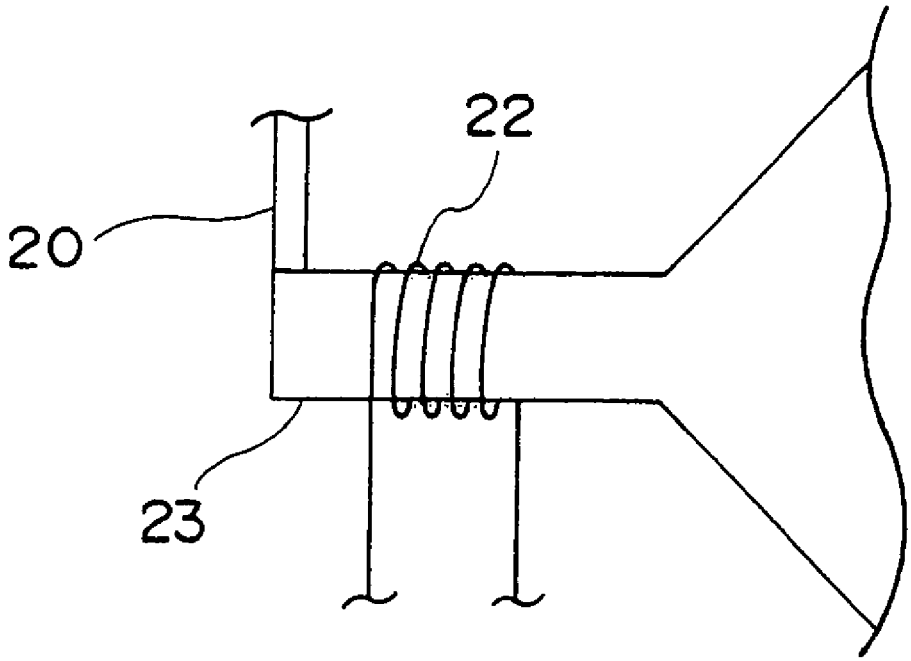
FIG. 5 is a schematic diagram showing another example of a plasma-generating apparatus that can be used in the present invention.

Alternatively, a plasma generating device shown in FIG. 5 may be used in place of the plasma generating device provided in the film forming device shown in FIGS. 4A and 4B. FIG. 5 is a schematic diagram showing an other example of a plasma generating device which can be utilized in the film forming device shown in FIGS. 4A and 4B. In FIG. 5, 22 represents a high frequency coil, 23 represents a quartz tube, and 20 is the same as that shown in FIGS. 4A and 4B. This plasma generating device is composed of the quartz tube 23, and the high frequency coil 22 provided along an external peripheral surface of the quartz tube 23, and one end of the quartz tube 23 is connected to the film forming chamber 10 (not shown in FIG. 5). In addition, the gas inlet 20 for introducing a gas into the quartz tube 23 is connected to another end of the quartz tube 23.

A bar-like shower nozzle 16 which is substantially parallel with a discharge surface is connected to a discharge surface side of the plate electrode 19, one end of the shower nozzle 16 is connected to the gas inlet 15, and this gas inlet 15 is connected to a second gas supplying source not shown, which is provided outside the film forming chamber 10.

In addition, the base rotation part 12 is provided in the film forming chamber 10, and a cylindrical tube substrate 14 is attached to the substrate rotation part 12 via the substrate holder 13 so that a longitudinal direction of the shower nozzle and an axial direction of the substrate 14 are faced substantially in parallel. Upon film forming, by rotating the substrate rotation part 12, the substrate 14 may be rotated in a circumferential direction. As the substrate 14, a photoreceptor in which lamination has been performed up to a photosensitive layer in advance, or a photoreceptor in which lamination has been performed up to an intermediate layer on a photosensitive layer is used.

In addition, a function separation type film forming method in which a reaction gas supply part and a reaction part are separated may be utilized.

Formation of the surface layer may be performed, for example, as follows: First, a $N_2$ gas, a $H_2$ gas and an oxygen gas are introduced into the high frequency discharge tube 21 through the gas inlet 20 and, at the same time, a 13.56 MHz radio wave is supplied to the plate electrode 19 from the high frequency power supplying part 18. Thereupon, the plasma diffusing part 17 is formed so that it is gradually expanded from a discharge surface side of the plate electrode 19 to the exhaust port 11 side.

Then, by introducing a trimethylgallium gas diluted with hydrogen into the film forming chamber 10 via the gas inlet 15 and the shower nozzle 16 using hydrogen as a carrier gas, an inorganic film containing oxygen and gallium and containing little hydrogen may be formed on a substrate 14 surface. The oxygen gas may be used by diluting with nitrogen, or an inert gas such as He, Ar and the like.

By introducing the $N_2$ gas, the $H_2$ gas and the oxygen gas into the high frequency discharge tube simultaneously as described above to make active species, thereby, decomposing the trimethylgallium gas, a compound of a group 13 element and oxygen containing little hydrogen may be prepared on the substrate.

Alternatively, a trimethylgallium gas may be reacted with a gas obtained by mixing an inert gas such as He, and oxygen in a plasma, or a mixed gas of nitrogen and oxygen, and a trimethylgallium gas may be reacted in a plasma.

A temperature for forming a surface layer upon film forming is not particularly limited, however when the surface layer is prepared on an amorphous silicon photoreceptor, the photoreceptor is preferably formed at 50° C. to 350° C. and, when the surface layer is prepared on an organic photoreceptor, the photoreceptor is preferably formed at 20° C. to 100° C. A temperature is a substrate surface temperature.

When the organic photoreceptor is prepared, a substrate surface temperature at film forming of a surface layer is preferably 100° C. or less, more preferably 80° C. or less. Since even when a substrate temperature is 100° C. or less, in the case where a temperature becomes higher than 150° C. by influence of a plasma, a photosensitive layer is damaged with heat in some cases, it is preferable to set a substrate temperature in view of such the influence.

A substrate temperature may be controlled by a method not shown, or a temperature may be raised naturally at discharge. When the substrate 14 is heated, a heater may be mounted on an outer side or on an inner side of the substrate 14. When the substrate 14 is cooled, a gas or a liquid for cooling may be circulated in an inner side of the substrate 14.

When a rise in a substrate temperature due to discharge is desirably avoided, it is effective to regulate an air stream having a high energy which contacts with a substrate 14 surface. In this case, the condition such as a gas flow rate, a discharge output and a pressure is adjusted so that a required temperature is obtained.

As a gas containing a group 13 element, an organic metal compound containing indium or aluminum, or hydride such as diborane may be used in place of the trimethylgallium gas, and two or more kinds of them may be mixed.

For example, when a film containing nitrogen and indium is formed on the substrate 14 by introducing trimethylindium into the film forming chamber 10 via the gas inlet 15 and the shower nozzle 16 at an initial stage of formation of a surface layer, this film may absorb an ultraviolet-ray which is produced when a film is continuously formed, and deteriorates a photosensitive layer. For this reason, damage on a photosensitive layer due to production of an ultraviolet-ray at film forming may be suppressed.

In addition, for controlling an electrical conductivity type, a dopant may be added to a surface layer.

As a method of doping a dopant at film forming, $SiH_3$ or $SnH_4$ for an n-type, and biscyclopentadienylmagnesium, dimethylcalcium, dimethylstrontium, dimethylzinc, or diethylzinc for a p-type, may be used in the gaseous state. For doping a dopant element into a surface layer, the known method such as a heat diffusion method, an ion injection method and the like may be adopted.

Specifically, by introducing a gas containing at least one dopant element into the film forming chamber 10 via the gas inlet 15 and the shower nozzle 16, an arbitrary electrical conductivity-type surface layer such as an n-type, a p-type and the like may be obtained.

When an inorganic film containing a group 13 element and oxygen is formed, an organic metal compound containing a hydrogen atom is used as a hydrogen supplying material, or hydrogen may be supplied from a hydrogen gas used as a carrier gas for an organic metal compound.

When a film containing mainly a group 13 atom and an oxygen atom is formed, active oxygen activated by a plasma is necessary, and may be obtained as explained below.

For example, when a hydrogen gas and an oxygen gas are introduced into a film forming device from separate positions in the film forming device shown in FIGS. 4A and 4B, plural plasma generating devices may be provided so that the activated state of a hydrogen gas, and the activated state of a oxygen gas may be each independently controlled. Alternatively, to the contrary, it is preferable that a gas containing an oxygen atom and a hydrogen gas simultaneously such as $H_3O$ as materials for supplying hydrogen and oxygen is used, and this is activated with a plasma, because a device may be simplified. By these methods, even at a low temperature of 100° C. or lower, a compound of a group 13 element and oxygen containing little hydrogen may be formed.

And, particularly, in order that absorption peak intensities showing bonds other than a bond between a group 13 element and oxygen are 0.1 times or lower of an absorption peak intensity showing a bond between a group 13 element and oxygen in an infrared absorption spectrum in a range of 4000 $cm^{-1}$ to 400 $cm^{-1}$ as in the invention, for example, as a gas spices, an organic metal compound containing a group 13 atom, and a compound containing an oxygen atom, or a mixture thereof, for example, an oxygen gas, a pressurized air, a mixture of an oxygen gas and a rare gas are used for trimethylgallium, trimethylindium, or trimethylaluminum. Further, a hydrogen gas, a nitrogen gas, a rare gas such as a helium gas, and the like are used.

Further, a gas composition is such that an oxygen atom is 1:0.01 or more and 1:1000 or less with respect to an organic metal compound containing a group 13 atom. If necessary, hydrogen, nitrogen, and a rare gas may be added for the purpose of stability of discharge, or removal of a carbon atom. In the case of the organic metal compound, hydrogen or a rare gas may be used as a carrier gas. Alternatively, only an organic metal compound, a carrier gas and an oxygen gas may be used, or an oxygen gas may be diluted with a carrier gas, or may be mixed with nitrogen. When nitrogen is contained in a film, a nitrogen gas may be added. When a hydrogen gas is mixed, this is preferable when a carbon atom is excluded from a film.

In addition, a film forming condition pressure is preferably 10 Pa to 300 Pa. A film forming substrate may be a cylindrical type photoreceptor or a belt-type photoreceptor. A substrate may be heated, or only heat at discharge may be used without heating. Further, cooling may be performed.

By the aforementioned method, activated hydrogen, oxygen, a rare gas and/or nitrogen, a group 13 atom are present on a substrate and, further, activated oxygen, a rare gas or hydrogen has the effect of eliminating hydrogen of a hydrocarbon group such as a methyl group and an ethyl group constituting an organic metal compound as a molecule. For this reason, on a substrate surface, a surface layer composed of a hard film in which oxygen and a group 13 element containing little hydrogen constitute a three-dimensional bond is formed at a low temperature.

Such the hard film is stable since Ga and O form a three-dimensional structure such as a tetrahedrally type of $sp^3$ bond and an octahedron bond. In addition, since extension resulting from a two-dimensional bond due to oxygen is also possessed, mechanically, stability, which can respond to flexibility, is exhibited. This hard film is transparent, and a surface of a film has high water repellency and sliding property, and low friction.

The plasma generating unit of the film forming device shown in FIGS. 4A and 4B uses a high frequency oscillating device, but is not limited to this, and for example, a microwave oscillating device may be used, or an electrocyclotron resonance method or a helicon plasma method device may be used. Alternatively, in the case of a high frequency oscillating device, the device may be an induction type or a capacity type.

Further, these devices may be used by combining two or more kinds, or two or more of the same kind of devices may be used. In order that irradiation with a plasma does not raise a substrate temperature, a high frequency oscillating device is preferable, and a device for preventing radiation of heat may be provided.

When two or more kinds of different plasma generating devices (plasma generating unit) are used, it is necessary that discharge may be given rise simultaneously at the same pressure. Alternatively, a difference in a pressure between a discharging region and a film forming region (a part in which a substrate is arranged) may be set. These devices may be arranged in series with respect to a gas stream which is formed from a gas introduction part to a gas exhaust part in a film forming device, or any device may be arranged opposite to a film-formed surface of a substrate.

For example, when two kinds of plasma generating unit are arranged in series with respect to a gas stream, by way of an example of the film forming device shown in FIG. 4, this can be utilized as a second plasma generating device which causes discharge in the film forming chamber 10 using the shower nozzle 16 as an electrode. In this case, by applying a high frequency voltage to the shower nozzle 16 via the gas introducing part 15, discharge can be caused in the film forming chamber 10 using the shower nozzle 16 as an electrode. Alternatively, in place of utilizing the shower nozzle 16 as an electrode, a cylindrical electrode is provided between the substrate 14 and the plasma generating region 19 in the film forming chamber 10, and this cylindrical electrode can be utilized to cause discharge in the film forming chamber 10.

In addition, when different two kinds of plasma generating devices are utilized under the same pressure, for example, when the microwave oscillating device and the high frequency oscillating device are used, an excitation energy of an excited spices can be largely changed, and this is effective for controlling film quality. In addition, discharge may be performed near the atmospheric pressure. When discharge is performed near the atmospheric pressure, it is desirable to use He as a carrier gas.

Upon formation of the surface layer, in addition to the aforementioned methods, a ordinary metal-organic chemical vapor deposition method and a molecular beam epitaxy method may be used and, also upon film forming by these methods, it is effective for lowering a temperature to use active oxygen, active nitrogen and/or active hydrogen. In this case, as an oxygen raw material, an oxygen gas, a water stream, the air and the like may be used. As a nitrogen raw material, a gas such as $N_2$, $NH_3$, $NF_3$, $N_2H_4$ and methylhydrazine, a vaporized liquid, or the gas or the vaporized liquid, which has been bubbled with a carrier gas, may be utilized.

(Conductive Substrate and Photosensitive Layer)

The photoreceptor of the invention is not particularly limited as long as its layer structure is such that a photosensitive layer and a surface layer are laminated on a conductive substrate in this order, and an undercoating layer may be provided between the conductive substrate and the photosensitive layer as necessary. The photosensitive layer may be two or more layers, and may be a function separation type. Further, in the photoreceptor of the invention, the photosensitive layer may be a so-called amorphous silicon photoreceptor containing a silicon atom.

In the case of the amorphous silicon photoreceptor, when the surface layer in the invention is used as a superficial part, image blurring at a high humidity may be prevented, and both of durability and high image quality may be realized. Particularly, it is preferable that the photosensitive layer is a so-called organic photoreceptor containing an organic material such as an organic photosensitive material. In the case of the organic photoreceptor, friction easily occurs, however when the surface layer in the invention is used in the superficial part, friction may be suppressed.

First, a summary of a preferable structure when the photoreceptor of the invention is the organic photoreceptor will be explained.

An organic polymer compound forming the photosensitive layer may be thermoplastic or thermosetting, or two kinds of organic polymer molecules may be reacted to form the photosensitive layer. In addition, from a viewpoint of adjustment of a hardness, an expansion coefficient and elasticity, and improvement in adherability, an intermediate layer may be provided between the photosensitive layer and the surface layer. It is preferable that the intermediate layer exhibits properties which are intermediate with respect to both of physical properties of the surface layer and the physical properties of the photosensitive layer (the charge transport layer in the case of the function-separation type). In addition, when the intermediate layer is provided, the intermediate layer may function as a layer which traps a charge.

In the case of the organic photoreceptor, the photosensitive layer may be a function separation type having the charge generation layer and the charge transport layer separately as shown in FIG. 1 and FIG. 2, or may be a function integration type as shown in FIG. 3. In the case of the function separation type, the surface side of the photoreceptor may be provided with the charge generation layer, or the surface side may be provided with the charge transport layer.

If a surface layer is formed on the photosensitive layer by a method described above, in order to prevent decomposition of the photosensitive layer due to the irradiation of electromagnetic radiation of shorter wavelengths other than heat, the photosensitive layer surface may be previously provided with a short-wavelength light absorber layer against ultraviolet light or the like, prior to formation of the surface layer. Moreover, so as not to irradiate short-wavelength light onto the photosensitive layer, a layer having a small band gap may be firstly formed at the initial stage for forming the surface layer. As to the composition of such a layer having a small band gap provided on the photosensitive layer side, for example the ratio of the group 13 element including In is suitably $Ga_X In_{(1-X)}$($0 \leqq X \leqq 0.99$). Regarding oxygen and nitrogen, the same conditions as described above are used.

Moreover, the layer containing an ultraviolet absorber (for example, a layer formed by application or the like of a layer dispersed in a polymeric resin) may be provided on the photosensitive layer surface.

In this manner, prior to formation of the surface layer and the like, the photoreceptor surface is provided with the intermediate layer, and thereby effects on the photosensitive layer by short-wavelength light such as ultraviolet light when forming the surface layer and the like, corona discharge if the photoreceptor is used in the image forming device, or ultraviolet light from other various light sources may be prevented.

Further, an amorphous carbon layer may be formed on the photosensitive layer.

Next is a description of the outline of an example of a structure where the photoreceptor of an exemplary embodiment of the present invention is an amorphous silicon photoreceptor.

The amorphous silicon photoreceptor may be a photoreceptor for either positive charging or negative charging. There may be used one such that on the conductive substrate is formed an under coating layer for blocking charge injection or improving the adhesiveness, and next is provided a photoconductive layer and a surface layer. The surface layer may be such that on the surface of the photosensitive layer is provided with an intermediate layer, on the surface of which is further provided with a surface layer. Or, on the surface of the photosensitive layer may be directly provided a surface layer.

Moreover, the outermost layer (layer on the surface layer side) of the photosensitive layer may be p-type amorphous silicon, or n-type amorphous silicon. Between the photosensitive layer and the surface layer may be formed with for example a $Si_XO_{1-X}$:H, $Si_XN_{1-X}$:H, $Si_XC_{1-X}$:H, amorphous carbon layer as an intermediate layer (charge injection arresting layer).

Next is a description of details of the conductive base substance and the photosensitive layer of the electrophotographic photoreceptor of an exemplary embodiment of the present invention, and details of the under coating layer and the intermediate layer provided as required, in the case where the electrophotographic photoreceptor of an exemplary embodiment of the present invention is for an organic photoreceptor having the function separation type photosensitive layer.

—Conductive Base Substance—

The conductive base substance includes: a metal drum of for example aluminum, copper, iron, stainless, zinc, and nickel; a metal such as aluminum, copper, gold, silver, platinum, palladium, titanium, nickel-chromium, stainless steel, and copper-indium deposited on a base material such as a sheet, a paper, a plastic, and a glass; a conductive metal compound such as indium oxide and tin oxide deposited on the base material; a metal foil laminated on the base material; and carbon black, indium oxide, tin oxide-antimony oxide powder, metal powder, copper iodide, and the like dispersed into a binder resin and applied on the base material for conduction treatment. Moreover, the shape of the conductive base substance may be any one of drum shape, sheet shape, and plate shape.

Moreover, if a metal pipe base substance is used as the conductive base substance, the surface of the metal pipe base substance may be the original pipe as it is. However, it is also possible to roughen the surface of the base substance surface by a surface treatment in advance. Such a surface roughening can prevent the uneven concentration in the grain form due to the coherent light which may occur in the photoreceptor if a coherent light source such as a laser beam is used as an exposure light source. The method of surface treatment includes specular cutting, etching, anodization, rough cutting, centerless grinding, sandblast, and wet honing.

In particular, from the point of improving the adhesiveness with the photosensitive layer and improving the film forming property, one having an anodized surface of the aluminum base substance may be preferably used as the conductive base substance.

Hereunder is a description of a method of manufacturing the conductive base substance having the anodized surface. First, as to the base substance, pure aluminum or aluminum alloy (for example, aluminum or aluminum alloy of an alloy number between 1000's, 3000's or 6000's defined in JISH4080(1999), the disclosure of which is incorporated by reference) is prepared. Next, anodization is performed. The anodization is performed in an acid solution of for example chromic acid, sulfuric acid, oxalic acid, phosphoric acid, boric acid, and sulfamic acid. However, treatment using a sulfuric acid solution is often used. The anodization is performed for example under a condition of about sulfuric acid concentration: 10 to 20 weight %: bath temperature: 5 to 25° C., current density: 1 to 4 A/dm$^2$, electrolysis voltage: 5 to 30V, and treatment time: 5 to 60 minutes, however it is not limited to this.

The anodized film formed on the aluminum base substance in this manner is porous and highly insulative, and has a very unstable surface. Therefore, after forming the film, the property value is easily changed with time. In order to prevent this change of the property value, the anodized film is further sealed. The sealing method includes a method of soaking the anodized film in an aqueous solution containing nickel fluoride or nickel acetate, a method of soaking the anodized film in boiling water, and a method of treating by steam under pressure. Among these methods, the method of soaking in an aqueous solution containing nickel acetate is most often used.

On the surface of the anodized film that has been sealed in this manner, metal salts and the like adhered by the sealing remain in excess. If such metal salts and the like remain in excess on the anodized film of the base substance, not only the quality of the coating film formed on the anodized film is badly affected, but also low resistant components tend to remain in general. Therefore, if this base substance is used for the photoreceptor to form an image, it becomes the causative factor of scumming.

Here, following the sealing, washing of the anodized film is performed in order to remove the metal salts and the like adhered by the sealing. The washing may be such that the base substance is washed once, however it may be such that the base substance is washed by multisteps of washing. As this time, as the washing solution at the last washing step, there is used clean (deionized) washing solution as much as possible. Moreover, in any one step among the multisteps of washing, a physical rubbing washing using a contact member such as a brush may be performed.

The thickness of the anodized film on the surface of the conductive base substance formed as above may be within a range of 3 to 15 μm. On the anodized film is present a layer called a barrier layer along the porous shaped most outer surface of a porous anodized film. The thickness of the barrier layer may be within a range of 1 to 100 nm in the photoreceptor used in an exemplary embodiment of the present invention. In the above manner, the anodized conductive base substance can be obtained.

In the conductive base substance obtained in this manner, the anodized film formed on the base substance by anodization has a high carrier blocking property. Therefore, the photoreceptor using this conductive base substance can be installed in the image forming device so as to prevent point defects (black dots and scumming) occurring if print off development (negative/positive development) is performed, and to prevent current leak phenomenon from a contact charging device which often occurs at the time of contact charging. Moreover, by sealing the anodized film, the change of the property value with time after forming the anodized film, may be prevented. Moreover, by washing the conductive base substance after sealing, the metal salts and the like adhered on the surface of the conductive base substance by sealing may be removed. If an image is formed by an image forming device comprising a photoreceptor produced using this conductive base substance, the occurrence of scumming can be sufficiently prevented.

—Under Coating Layer—

Next is a description of the under coating layer. The material of the under coating layer includes: a polymeric resin compound such as an acetal resin such as polyvinyl butyral; a polyvinylalcohol resin, casein, a polyamide resin, a cellulose resin, a gelatin, a polyurethane resin, a polyester resin, a methacrylic resin, an acrylic resin, a polyvinylchloride resin, a polyvinyl acetate resin, a vinyl chloride-vinyl acetate-maleic anhydride resin, a silicone resin, a silicone-alkyd resin, a phenol-formaldehyde resin, and a melamine resin; and in addition, an organometallic compound containing zirconium, titanium, aluminum, manganese, silicon atoms, and the like.

These compounds may be used solely, or as a mixture or polycondensate of plural compounds. Among them, an organometallic compound containing zirconium or silicon is preferably used since it has a low residual potential, low potential change due to environment, and low potential change due to repetitive usage. Moreover, the organometallic compound may be used solely, or as a mixture of plural types, or a mixture with the abovementioned binder resin.

The organic silicon compound (organometallic compound containing silicon atoms) includes vinyltriethoxysilane, vinyltrimethoxysilane, vinyltris(2-methoxyethoxysilane) γ-methacryloxypropyltrimethoxysilane, γ-methacryloxypropyl-tris (β-methoxyethoxy)silane, β-(3,4-epoxycyclohexyl) ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N-β-(aminoethyl)-γ-aminopropylmethyljimethoxysilane, N,N-bis(β-hydroxyethyl)-γ-aminopropyltriethoxysilane, N-phenyl-3-aminopropyltrimethoxysilane, γ-mercaptopropyltrimethoxysilane and γ-chloropropyltrimethoxysilane. Among them, there is preferably used a silane coupling agent such as vinyltriethoxysilane, vinyltris(2-methoxyethoxysilane), γ-methacryloxypropyltrimethoxysilane, γ-glycidoxypropyltrimethoxysilane, β-(3,4-epoxycyclohexyl)ethyltrimethoxysilane, N-β-(aminoethyl)-γ-aminopropyltrimethoxysilane, N-β-(aminoethyl)-γ-aminopropylmethyldimethoxysilane, γ-aminopropyltriethoxysilane, N-phenyl-3-aminopropyltrimethoxysilane, γ-mercaptopropyltrimethoxysilane, and γ-chloropropyltrimethoxysilane.

The organic zirconium compound (organometallic compound containing zirconium) includes zirconium butoxide, ethyl zirconium acetoacetate, zirconium triethanolamine, acetylacetonato zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide and isostearate zirconium butoxide.

The organic titanium compound (organometallic compound containing titanium) includes tetraisopropyl titanate, tetranormalbutyl titanate, butyl titanate dimer, tetra(2-ethylhexyl) titanate, titanium acetylacetonate, polytitanium acetylacetonate, titanium octylene glycolate, titanium lactate ammonium salt, titanium lactate, titanium lactate ethyl ester, titanium triethanolaminate and polyhydroxytitanium stearate.

The organic aluminum compound (organometallic compound containing aluminum) includes aluminum isopropylate, monobutoxyaluminum diisopropylate, aluminum butyrate, diethylacetoacetate aluminum diisopropylate and aluminum tris(ethylacetoacetate).

Moreover, the solvent used for the under coating layer forming coating liquid which is for forming the under coating layer includes a publicly known organic solvent for example: an aromatic hydrocarbon solvent, such as toluene and chlorobenzene; an aliphatic alcohol solvent, such as methanol, ethanol, n-propanol, iso-propanol and n-butanol; a ketone solvent such as acetone, cyclohexanone, and 2-butanone; a halogenated aliphatic hydrocarbon solvent such as methylene chloride, chloroform, and ethylene chloride; a cyclic or linear ether solvent such as tetrahydrofuran, dioxane, ethylene glycol, diethylether; and an ester solvent such as methyl acetate, ethyl acetate, and n-butyl acetate. These solvents may be used solely or as a mixture of plural types. As a solvent which can be used when plural types of solvents are mixed, any solvent may be used as long as a binder resin can be dissolved therein as a mixed solvent.

In the formation of the under coating layer, firstly an under coating layer forming coating liquid that has been formulated by dispersing and mixing under coating layer coating agent and a solvent is prepared, and applied on the surface of the conductive base substance. As the application method of the under coating layer forming coating liquid, there may be used a normal method such as a dip coating method, a ring coating method, a wire bar coating method, a spray coating method, a blade coating method, a knife coating method, and a curtain coating method. If the under coating layer is formed, it may be formed so that the thickness is within a range of 0.1 μm to 3 μm. By setting the thickness of the under coating layer within such a thickness range, potential increase due to desensitization or repetition may be prevented without overstrengthening the electrical barrier.

In this manner, by forming the under coating layer on the conductive base substance, the wettability when coating to form a layer on the under coating layer may be improved, and it can sufficiently serve a function as an electrical blocking layer.

The surface roughness of the under coating layer formed by the above can be adjusted so as to have a roughness within a range between 1 and 1/(4n) times the laser wavelength λ for exposure to be used (where n is the refractive index of a layer provided on the periphery of the under coating layer). The surface roughness is adjusted by adding resin particles in the under coating layer forming coating liquid. By so doing, if the photoreceptor formed by adjusting the surface roughness of the under coating layer is used for the image forming device, interference fringes due to the laser source may be sufficiently prevented.

As the resin particles, there may be used silicone resin particles, cross-linked PMMA (polymethylmethacrylate) resin particles, and the like. Moreover, for adjusting the surface roughness, the surface of the under coating layer may be ground. As the grinding method, there may be used buffing, sandblasting, wet honing, grinding treatment, and the like. In the photoreceptor used for the image forming device of the configuration of positive charging, laser incident beams are absorbed in the vicinity of the most outer surface of the photoreceptor, and further scattered in the photosensitive layer. Therefore, it is not so strongly needed to adjust the surface roughness of the under coating layer.

Moreover, various additives may be added into the under coating layer forming coating liquid, in order to improve the electrical characteristic, the environmental stability, and the image quality. As the additive, there may be used a publicly known material, for example: an electron transport material such as a quinone compound such as chloranil, bromanil, and anthraquinone, a tetracyanoquinodimethane compound, a fluorenone compound such as 2,4,7-trinitrofluorenone and 2,4,5,7-tetranitro-9-fluorenone, an oxadiazole compound such as 2-(4-biphenyl)-5-(4-t-butylphenyl)-1,3,4-oxadiazole, 2,5-bis(4-naphthyl)-1,3,4-oxadiazole, 2,5-bis(4-diethylaminophenyl)1,3,4 oxadiazole, a xanthone compound, a thiophene compound, a diphenoquinone compound such as 3,3',5,5' tetra-t-butyldiphenoquinone; an electron transport pigment such as polycyclic condensate or azo, a zirconium chelate compound, a titanium chelate compound, an aluminum chelate compound, a titanium alkoxide compound, an organic titanium compound, and a silane coupling agent.

Specific examples of the silane coupling agent used here include silane coupling agents such as vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N, N-bis(β-hydroxyethyl)-γ-aminopropyltriethoxysilane, and γ-chloropropyltrimethoxysilane. However, it is not limited to these.

Specific examples of the zirconium chelate compound include zirconium butoxide, zirconium ethyl acetoacetate, zirconium triethanolamine, acetylacetonate zirconium butoxide, ethyl acetoacetatezirconium butoxide, zirconium acetate, zirconium oxalate, zirconium lactate, zirconium phosphnate, zirconium octanoate, zirconium naphthenate, zirconium laurate, zirconium stearate, zirconium isostearate, methacrylate zirconium butoxide, stearate zirconium butoxide, and isostearate zirconium butoxide.

Specific examples of the titanium chelate compound include tetraisopropyl titanate, tetranormalbutyl titanate, butyl titanate dimer, tetra(2-ethylhexyl) titanate, titaniumacetylacetonate, polytitaniumacetylacetonate, titanium octylene glycolate, titanium lactate ammonium salt, titanium lactate, titanium lactate ethyl ester, titanium triethanolaminate and polyhydroxytitanium stearate.

Specific examples of the aluminum chelate compound include aluminum isopropylate, monobutoxyaluminum diisopropylate, aluminum butyrate, diethylacetoacetate aluminum diisopropylate and aluminum tris(ethylacetoacetate).

These additives may be used solely, or as a mixture or polycondensate of plural compounds.

Moreover, the abovementioned under coating layer forming coating liquid may contain at least one type of electron accepting material. Specific examples of the electron accepting material include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Among them, there are particularly preferably used fluorenones, quinines, and benzenes having an electron attractive substituent such as Cl, CN, and $NO_2$. As a result, in the photosensitive layer, the photosensitivity may be improved, the residual potential may be decreased, and the deterioration of photosensitivity when used repeatedly may be reduced. The uneven concentration of the toner image formed by the image forming device comprising the photoreceptor containing an electron accepting material in the under coating layer may be sufficiently prevented.

Moreover, a dispersion type under coating layer coating agent described below may be used instead of the abovementioned under coating layer coating agent. As a result, by appropriately adjusting the resistance of the under coating layer, residual charge may be prevented from being accumulated, and the under coating layer may be made thicker. Therefore, the leak resistance of the photoreceptor may be improved, in particular, leaking at the time of contact charging may be prevented.

This dispersion type under coating layer coating agent includes: metal powder such as aluminum, copper, nickel, and silver; conductive metal oxide such as antimony oxide, indium oxide, tin oxide, and zinc oxide; and conductive material such as carbon fiber, carbon black, and graphite powder dispersed in a binder resin. As the conductive metal oxide, metal oxide particles having a mean primary particle size of 0.5 μm or less may be used. If the mean primary particle size is too large, conduction paths are often generated locally, readily causing current leaking, which may result in the occurrence of fogging or leaking of large current from the charging device. The under coating layer is needed to be adjusted to an appropriate resistance in order to improve the leak resistance. Therefore, the abovementioned particles may have a powder resistance of about $10^2$ to $10^{11}$ Ω·cm.

If the resistance of the metal oxide particle is lower than the lower limit of the above range, sufficient leak resistance may not be obtained. If it is higher than the upper limit of this range, the residual potential may be increased. Consequently, among them, metal oxide particles such as tin oxide, titanium oxide, and zinc oxide are preferably used. Moreover, the metal oxide particles may be used in a mixture of plural types thereof. Furthermore, by performing the surface treatment on the metal oxide particles using a coupling agent, the resistance of the powder may be controlled. As the coupling agent that may be used in this case, similar materials as those for the abovementioned under coating layer forming coating liquid can be used. Moreover, these coupling agents may be used in a mixture of plural types thereof.

In this surface treatment of the metal oxide particles, any method can be used as long as publicly known, and either a dry method or wet method may be used.

If a dry method is used, firstly the metal oxide particles are heated and dried, to remove the surface adsorbed water. By removing the surface adsorbed water, the coupling agent may be evenly absorbed on the surface of the metal oxide particles. Next, while stirring the metal oxide particles by a mixer or the like having a large shearing force, the coupling agent, either directly or dissolved in an organic solvent or water, is dropped or sprayed with dry air or nitrogen gas, and thereby the treatment is evenly performed. When the coupling agent is dropped or sprayed, the treatment may be performed at a temperature of 50° C. or more. After adding or spraying the coupling agent, printing may be further performed at a temperature of 100° C. or more. By the effect of the printing, the coupling agent can be cured and a firm chemical reaction with the metal oxide particles can be generated. The printing may be performed at a temperature at which a desired electrophotographic characteristic is obtained, for an optional range of time.

If a wet method is used, similarly to the dry method, firstly the surface adsorbed water on the metal oxide particles is removed. As the method of removing the surface adsorbed water, in addition to the heat and dry method which is similar to the dry method, there may be performed a method of removing by stirring and heating in a solvent used for surface treatment, and a method of removing by azeotroping with a solvent. Next, the metal oxide particles are stirred in a solvent, and dispersed by using ultrasonic waves, a sandmill, an attritor, a ball mill, or the like. The coupling agent solution is added thereinto, and stirred or dispersed. Then, the solvent is removed, and thereby the treatment is evenly performed. After removing the solvent, printing may be further performed at a temperature of 100° C. or more. The printing may be performed at a temperature at which a desired electrophotographic characteristic is obtained, for an optional range of time.

The amount of the surface treatment agent with respect to the metal oxide particles may be an amount by which a desired electrophotographic characteristic is obtained. The electrophotographic characteristic is affected by the amount of the surface treatment agent adhered on the metal oxide particles after surface treatment. In the case of the silane coupling agent, the adhered amount is obtained by the Si intensity measured by fluorescent X-ray spectroscopy (caused by silane coupling agent), and the intensity of the main metal element used in the metal oxide. The Si intensity measured by fluorescent X-ray spectroscopy may be preferably within a range of $1.0\times10^{-5}$ to $1.0\times10^{-3}$ times of the intensity of the main metal element used in the metal oxide. If it is lower than this range, image defects such as fogging may often occur. If it exceeds this range, the concentration may be often decreased due to an increase in the residual potential.

The binding resin contained in the dispersion type under coating layer coating agent include: a publicly known polymeric resin compound such as an acetal resin such as polyvinyl butyral, a polyvinylalcohol resin, casein, a polyamide resin, a cellulose resin, a gelatin, a polyurethane resin, a polyester resin, a methacrylic resin, an acrylic resin, a polyvinylchloride resin, a polyvinyl acetate resin, a vinyl chloride-vinyl acetate-maleic anhydride resin, a silicone resin, a silicone-alkyd resin, a phenol resin, a phenol-formaldehyde resin, a melamine resin, and an urethane resin; a charge transport resin having a charge transport group; and a conductive resin such as polyaniline.

Among them, there is preferably used a resin that is insoluble in a coating solvent of a layer formed on the under coating layer. In particular, a phenol resin, a phenol-formaldehyde resin, a melamine resin, an urethane resin, an epoxy resin, and the like are preferably used. The ratio of the metal oxide particles to the binder resin in the dispersion type under coating layer forming coating liquid can be optionally set within a range by which a desired photoreceptor characteristic is obtained.

The method of dispersing the metal oxide particles that have been surface treated by the above method into the binder resin, include a method using a media disperser such as a ball mill, a vibratory ball mill, an attritor, a sandmill, and a horizontal sandmill, or a medialess disperser such as an agitator, an ultrasonic disperser, a roll mill, and a high pressure homogenizer. Furthermore, the high pressure homogenizer includes a collision method where a dispersing liquid is dispersed by liquid-liquid collision or liquid-wall collision under a high pressure, and a penetration method where a dispersing liquid is dispersed by making it penetrate through minute channels under a high pressure.

The method of forming the under coating layer by this dispersion type under coating layer coating agent can be performed similarly to the method of forming the under coating layer using the abovementioned under coating layer coating agent.

—Photosensitive Layer: Charge Transport Layer—

Next is a description of the photosensitive layer, separately for the charge transport layer and the charge generation layer in this order.

Examples of the charge transport material used for the charge transport layer are as follows. That is, there is used a hole transport material such as: oxadiazoles such as 2,5-bis (p-diethylaminophenyl)-1,3,4-oxadiazole; pyrazolines such as 1,3,5-triphenyl-pyrazoline, and 1-[pyridyl-(2)]-3-(p-diethylaminostyryl)-5-(p-diethylaminostyryl)pyrazoline; an aromatic tertiary amino compound such as triphenylamine, tri(P-methyl)phenylamine, N,N-bis(3,4-dimethylphenyl)biphenyl-4-amine, dibenzylaniline, and 9,9-dimethyl-N,N-di (p-tolyl)fluorenone-2-amine; an aromatic tertiary diamino compound such as N,N'-diphenyl-N,N'-bis(3-methylphenyl)-[1,1-biphenyl]4,4'-diamine; 1,2,4-triazines such as 3-(4'-dimethylaminophenyl)-5,6-di-(4'-methoxyphenyl)-1,2,4-triazine; hydrazones such as 4-diethylaminobenzaldehyde-1,1-diphenylhydrazone, 4-diphenylaminobenzaldehyde-1,1-diphenylhydrazone, [p-(diethylamino)phenyl](1-naphthyl)phenylhydrazone, 1-pyrenediphenylhydrazone, 9-ethyl-3-[(2methyl-1-indolinylimino)methyl]carbazole, 4-(2-methyl-1-indolinyliminomethyl)triphenylamine, 9-methyl-3-carbazolediphenylhydrazone, 1,1-di-(4,4'-methoxyphenyl)acrylaldehydediphenylhydrazone, and β,β-bis (methoxyphenyl)vinyldiphenylhydrazone; quinazolines such as 2-phenyl-4-styryl-quinazoline; benzofurans such as 6-hydroxy-2,3-di(p-methoxyphenyl)-benzofuran; α-stilbenes such as p-(2,2-diphenylvinyl)-N,N-diphenylaniline; enamines; carbazoles such as N-ethylcarbazole; poly-N-vinylcarbazole and the derivatives thereof. Alternatively, it includes a polymer having a group comprising the above compound on the main chain or side chain. These charge transport materials may be used solely or in combination of plural types thereof.

Any binder resin may be used as the binder resin used for the charge transport layer. However, in particular, preferably the binder resin is compatible with the charge transport material and has an appropriate strength.

Examples of this binder resin include: various polycarbonate resins of bisphenol A, bisphenol Z, bisphenol C, bisphenol TP, and the like, and the copolymer thereof; a polyalylate resin and the copolymer thereof; a polyester resin; a methacrylic resin; an acrylic resin; a polyvinylchloride resin; a polyvinylidene chloride resin; a polystyrene resin; a polyvinyl acetate resin; a styrene-butadiene copolymer resin; a vinyl chloride-vinyl acetate copolymer resin; a vinyl chloride-vinyl acetate-maleic anhydride copolymer resin; a silicone resin; a silicone-alkyd resin; a phenol-formaldehyde resin; a styrene-acrylic copolymer resin, an stylene-alkyd resin; a poly-N-vinylcarbazole resin; a polyvinyl butyral resin; and a polyphenylene ether resin. These resins may be used solely, or as a mixture of plural types thereof.

The molecular weight of the binder resin used for the charge transport layer is suitably selected according to the film forming condition such as the thickness of the photosensitive layer, the solvent, or the like. However, normally, preferably the viscosity-average molecular weight is within a range of 3000 to $300\times10^3$, and more preferably a range of $20\times10^3$ to $200\times10^3$.

The charge transport layer can be formed by applying and drying a solution having the charge transport material and the binder resin dissolved in an appropriate solvent. Examples of the solvent used for forming the charge transport layer forming coating liquid include: aromatic hydrocarbons, such as benzene, toluene, and chlorobenzene; ketones such as acetone and 2-butanone; halogenated aliphatic hydrocarbons such as methylene chloride, chloroform, and ethylene chloride; cyclic or linear ethers such as tetrahydrofuran, dioxane, ethylene glycol, diethylether; and mixed solvents thereof. The mix proportion of the charge transport material and the binder resin may be within a range between 10:1 and 1:5. Moreover, generally, the thickness of the charge transport layer is preferably within a range of 5 μm to 50 μm, and more preferably within a range of 10 μm and 40 μm.

The charge transport layer and/or the charge generation layer described later may contain additives such as an antioxidant, a photostabilizer, and a thermal stabilizer, in order to prevent the deterioration of the photoreceptor due to ozone or oxidizing gas generated in the image forming device, light, or heat.

The antioxidant includes hindered phenol, hindered amine, paraphenylendiamin, arylalkane, hydroquinone, spirochromans, spiroindanone, or the derivatives thereof, an organic sulfur compound, and an organophosphorus compound.

Specific examples of the compound of the antioxidant include: a phenolic antioxidant such as 2,6-di-t-butyl-4-methylphenol, styrenated phenol, n-octadecyl-3-(3',5'-di-t-butyl-4'-hydroxyphenyl)-propionate, 2,2'-methylene-bis-(4-methyl-6-t-butylphenol), 2-t-butyl-6-(3'-t-butyl-5'-methyl-2'-hydroxybenzyl)-4-methylphenylacrylate, 4,4'-butylidene-bis-(3-methyl-6-t-butyl-phenol), 4,4'-thio-bis-(3-methyl-6-t-butylphenol), 1,3,5-tris(4-t-butyl-3-hydroxy-2,6-dimethylbenzyl)isocyanurate, tetrakis-[methylene-3-(3',5'-di-t-butyl-4'-hydroxy-phenyl)propionate]-methane, and 3,9-bis[2-[3-(3-t-butyl-4-hydroxy-5-methylphenyl) propionyloxy]-1,1-dimethylethyl]-2,4,8,10-tetraoxaspiro[5,5]undecane, 3-3',5'-di-t-butyl-4'-hydroxyphenyl)stearyl propionate.

The hindered amine compound includes bis(2,2,6,6-tetramethyl-4-piperidyl)sebacate, bis(1,2,2,6,6-pentamethyl-4-piperidyl)sebacate, 1-[2-[3-(3,5-di-t-butyl-4-hydroxyphenyl)propionyloxy]ethyl]-4-[3-(3,5-di-t-butyl-4-hydroxyphenyl)propionyloxy]-2,2,6,6-tetramethylpiperidine, 8-benzyl-7,7,9,9-tetramethyl-3-octyl-1,3,8-triazaspiro[4,5]undecane-2,4-dione, 4-benzoyloxy-2,2,6,6-tetramethylpiperidine, succinic acid dimethyl-1-(2-hydroxyethyl)-4-hydroxy-2,2,6,6-tetramethylpiperidine polycondensate, poly[{6-(1,1,3,3-tetramethylbutyl)imino-1,3,5-triazine-2,4-diimyl} {(2,2,6,6-tetramethyl-4-piperidyl) imino}hexamethylene{(2,3,6,6-tetramethyl-4-piperidyl) imino}], 2-(3,5-di-t-butyl-4-hydroxybenzyl)-2-n-butyl malonic acid bis(1,2,2,6,6-pentamethyl-4-piperidyl), and N,N'-bis(3-aminopropyl)ethylenediamine-2,4-bis[N-butyl-N-(1,2,2,6,6, -pentamethyl-4piperidyl)amino]-6-chloro-1,3,5-triazine condensate.

The organic sulfur antioxidant includes dilauryl-3,3'-thiodipropionate, dimyristyl-3,3'-thiodipropionate, distearyl-3,3'-thiodipropionate, pentaerythritol-tetrakis-(β-lauryl-thiopropionate), ditridecyl-3,3'-thiodipropionate, and 2-mercaptobenzimidazole.

The organophosphorus antioxidant includes trisnonylphenylphosphate, triphenylphosphate, and tris(2,4-di-t-butylphenyl)-phosphate.

The organic sulfur antioxidants and organophosphorus antioxidants are called a secondary antioxidant, which can increase the antioxidative effect synergistically by using with a primary antioxidant such as phenols or amines.

The photostabilizer includes derivatives of for example benzophenones, benzotriazoles, dithiocarbamates, and tetramethylpiperidines.

The benzophenone photostabilizer includes 2-hydroxy-4-methoxybenzophenone, 2-hydroxy-4-octoxybenzophenone, and 2,2'-di-hydroxy-4-methoxybenzophenone.

The benzotriazole photostabilizer includes 2-(-2'-hydroxy-5'methylphenyl-)-benzotriazole, 2-[2'-hydroxy-3'-(3",4",5",6"-tetra-hydrophthalimide-methyl)-5'-methylphenyl]-benzotriazole, 2-(-2'-hydroxy-3'-t-butyl 5'-methylphenyl-)-5-chlorobenzotriazole, 2-(-2'-hydroxy-3'-t-butyl-5'-methylphenyl)-5-chloro benzotriazole, 2-(2'-hydroxy-3',5'-t-butylphenyl)-benzotriazole, 2-(2'-hydroxy-5'-t-octylphenyl)-benzotriazole, and 2-(2'-hydroxy-3', 5'-di-t-amylphenyl-)-benzotriazole.

Other photostabilizers include 2,4, di-t-butylphenyl-3',5'-di-t-butyl-4'-hydroxybenzoate, and nickel dibutyl-dithiocarbamate.

The charge transport layer can be formed by applying and drying a solution having the charge transport material and the binder resin dissolved in an appropriate solvent. Examples of the solvent used for adjusting the charge transport layer forming coating liquid include: aromatic hydrocarbons, such as benzene, toluene, and chlorobenzene; ketones such as acetone and 2-butanone; halogenated aliphatic hydrocarbons such as methylene chloride, chloroform, and ethylene chloride; cyclic or linear ethers such as tetrahydrofuran, dioxane, ethylene glycol, diethylether; and mixed solvents thereof.

Moreover, the charge transport layer forming coating liquid may added with a small amount of silicone oil as a leveling agent for improving the smoothness of the coating film formed by coating.

The mix proportion of the charge transport material and the binder resin may be within a range of 10:1 to 1:5 by weight. Moreover, generally, the thickness of the charge transport layer is preferably within a range of 5 μm to 50 μm, and more preferably within a range of 10 μm to 30 μm.

The application of the charge transport layer forming coating liquid can be performed according to the shape and usage of the photoreceptor, by using a method such as a dip coating method, a ring coating method, a spray coating method, a bead coating method, a blade coating method, a roller coating method, a knife coating method, and a curtain coating method. It is preferable to heat and dry after becoming dry to touch at a room temperature. The heating and drying may be performed in a temperature range of 30° C. to 200° C., for 5 minutes to 2 hours.

—Photosensitive Layer: Charge Generation Layer—

The charge generation layer is formed by deposition of a charge generating material by a vacuum deposition method, or coating of a solution containing an organic solvent and a binder resin.

As to the charge generating material, there may be used: amorphous selenium, crystalline selenium, selenium-tellurium alloy, selenium-arsenic alloy, and other selenium compounds; an inorganic photoconductor such as selenium alloy, zinc oxide, and titanium oxide; or a dye-sensitized material thereof; various phthalocyanine compound such as metal-free phthalocyanine, titanyl phthalocyanine, copper phthalocyanine, tin phthalocyanine, and galliumphthalocyanine; various organic pigments such as squaryliums, anthanthrones, perylenes, azos, anthraquinones, pyrenes, pyrylium salt, and thia pyrylium salt; or dyes.

Moreover, these organic pigments generally have several types of crystal forms. In particular, for the phthalocyanine compound, various crystal forms are known such as α type and β type. As long as the pigment provides the sensitivity or other characteristics according to the purpose, any of these crystal forms can be used.

Among the abovementioned charge generating materials, phthalocyanine compounds are preferred. In this case, if light is irradiated on the photosensitive layer, the phthalocyanine compound contained in the photosensitive layer absorbs photons and generates carriers. At this time, since the phthalocyanine compound has a high quantum efficiency, the absorbed photons can be efficiently absorbed to generate carriers.

Furthermore, among the phthalocyanine compound, the phthalocyanine as shown in the following (1) to (3) are more preferred. That is:

(1) Hydroxy gallium phthalocyanine of a crystal form having diffraction peaks at least in the positions of 7.6°, 10.0°, 25.2°, and 28.0° in the Bragg angle (2θ±0.2°) of an X-ray diffraction spectrum using Cuk-α rays as a charge generating material.

(2) Chlorogallium phthalocyanine of a crystal form having diffraction peaks at least in the positions of 7.3°, 16.5°, 25.4°, and 28.1° in the Bragg angle (2θ±0.2°) of an X-ray diffraction spectrum using Cuk-α ray as a charge generating material.

(3) Titanyl phthalocyanine of a crystal form having diffraction peaks at least in the positions of 9.5°, 24.2°, and 27.3° in the Bragg angle (2θ±0.2°) of an X-ray diffraction spectrum using Cuk-α ray as a charge generating material.

These phthalocyanine compounds have not only high photosensitivity in particular, but also high stability of the photosensitivity. Therefore, the photoreceptor having the photosensitive layer containing these phthalocyanine compounds is suitable as a photoreceptor of a color image forming apparatus which requires high speed image formation and repetitive reproducibility.

Due to the crystal shape and the measurement method, these peak intensity and the position may be slightly out from these values. However, as long as the X-ray diffraction pattern is basically matched, it can be judged to be the same crystal form.

Examples of this binder resin used for the charge generation layer include the following. That is, polycarbonate resins such as bisphenol A type and bisphenol Z type, and the copolymer thereof; a polyalylate resin; a polyester resin; a methacrylic resin; an acrylic resin; a polyvinylchloride resin; a polystyrene resin; a polyvinyl acetate resin; a styrene-butadiene copolymer resin; a vinylidene chloride-acrylnitryl copolymer resin; a vinyl chloride-vinyl acetate-maleic anhydride copolymer resin; a silicone resin; a silicone-alkyd resin; a phenol-formaldehyde resin; styrene-alkyd resin; and a poly-N-vinylcarbazole.

These binder resins may be used solely or in combination of a plurality of types thereof. The mix proportion of the charge transport material and the binder resin is desirably within a range of 10:1 to 1:10 by weight. Moreover, generally, the thickness of the charge transport layer is preferably within a range of 0.01 μm to 5 μm, and more preferably within a range of 0.05 μm to 2.0 μm.

Moreover, the charge generation layer may contain at least one type of electron accepting material in order to improve the sensitivity, decrease the residual potential, and decrease the fatigue at the time of repetitive usage. Examples of the electron accepting material used for the charge generation layer include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Among them, there are particularly preferred fluorenones, quinines, and benzenes having an electron attractive substituent such as Cl, CN, and $NO_2$.

As the method of dispersing the charge generating material into a resin, there may be used a method such as a roll mill, a ball mill, a vibratory ball mill, an attritor, a dinomill, a sandmill, and a colloid mill.

The solvent of the coating liquid for forming the charge generation layer includes a publicly known organic solvent for example: an aromatic hydrocarbon solvent, such as toluene and chlorobenzene; an aliphatic alcohol solvent, such as methanol, ethanol, n-propanol, iso-propanol and n-butanol; a ketone solvent such as acetone, cyclohexanone, and 2-butanone; a halogenated aliphatic hydrocarbon solvent such as methylene chloride, chloroform, and ethylene chloride; a cyclic or linear ether solvent such as tetrahydrofuran, dioxane, ethylene glycol, diethylether; and an ester solvent such as methyl acetate, ethyl acetate, and n-butyl acetate.

These solvents may be used solely or as a mixture of plural types. If plural types of solvents are mixed, any solvent may be used as long as a binder resin can be dissolved therein as a mixed solvent. However, if the photosensitive layer has a layer structure where the charge transport layer and the charge generation layer are formed in this order from the conductive base substance side, when the charge generation layer is formed using an application such as dip coating in which the lower layer is readily dissolved, a solvent which does not dissolve the lower layer such as the charge transport layer is desirably used. Moreover, when the charge generation layer is formed using a spray coating method or a ring coating method, in which the lower layer is eroded relatively less, the solvent can be widely selected.

—Intermediate Layer—

As to the intermediate layer, for example when the photoreceptor surface is charged by an charging device, in order to prevent a situation where the charging potential can not be obtained by injecting the electrification charges from the photoreceptor surface to the conductive base substance of the photoreceptor serving as the opposed electrode, a charge injection arresting layer may be formed as required between the surface protective layer and the charge generation layer.

As to the material of the charge injection arresting layer, there may be used the abovementioned silane coupling agent, titanium coupling agent, organic zirconium compound, and organic titanium compound, other organometallic compounds, and a widely-used resin such as polyester, and polyvinyl butyral. The thickness of the charge injection arresting layer is appropriately set by considering the film forming property and the carrier blocking property, within a range of about 0.001 μm to 5 μm.

(Process Cartridge and Image Forming Device)

Next is a description of the process cartridge and the image forming device using the photoreceptor of an exemplary embodiment of the present invention.

The process cartridge of an exemplary embodiment of the present invention is not specifically limited if the photoreceptor of an exemplary embodiment of the present invention is used. However, specifically, it may be a process cartridge integrally having the photoreceptor of an exemplary embodiment of the present invention and any one selected from a charging device, a development device and a cleaning device, and being detachable from the image forming device main body.

Moreover, the image forming device of an exemplary embodiment of the present invention is not specifically limited if the photoreceptor of an exemplary embodiment of the present invention is used. However, specifically, it may include the photoreceptor of an exemplary embodiment of the present invention, an charging device that charges this photoreceptor surface, an exposure device (electrostatic latent image forming device) that exposes the photoreceptor surface charged by the charging device to form an electrostatic latent image, a development device that develops the electrostatic latent image by a developer containing a toner to form a toner image, and a transfer device that transfers the toner image onto a recording media. The image forming device of an exemplary embodiment of the present invention may be a so-called tandem device which has plural photoreceptors corresponding to toners of respective colors. In this case, all photoreceptors may be the photoreceptor of an exemplary embodiment of the present invention. Moreover, the toner image may be transferred by the intermediate transfer method using an intermediate transfer body.

Figure 6:
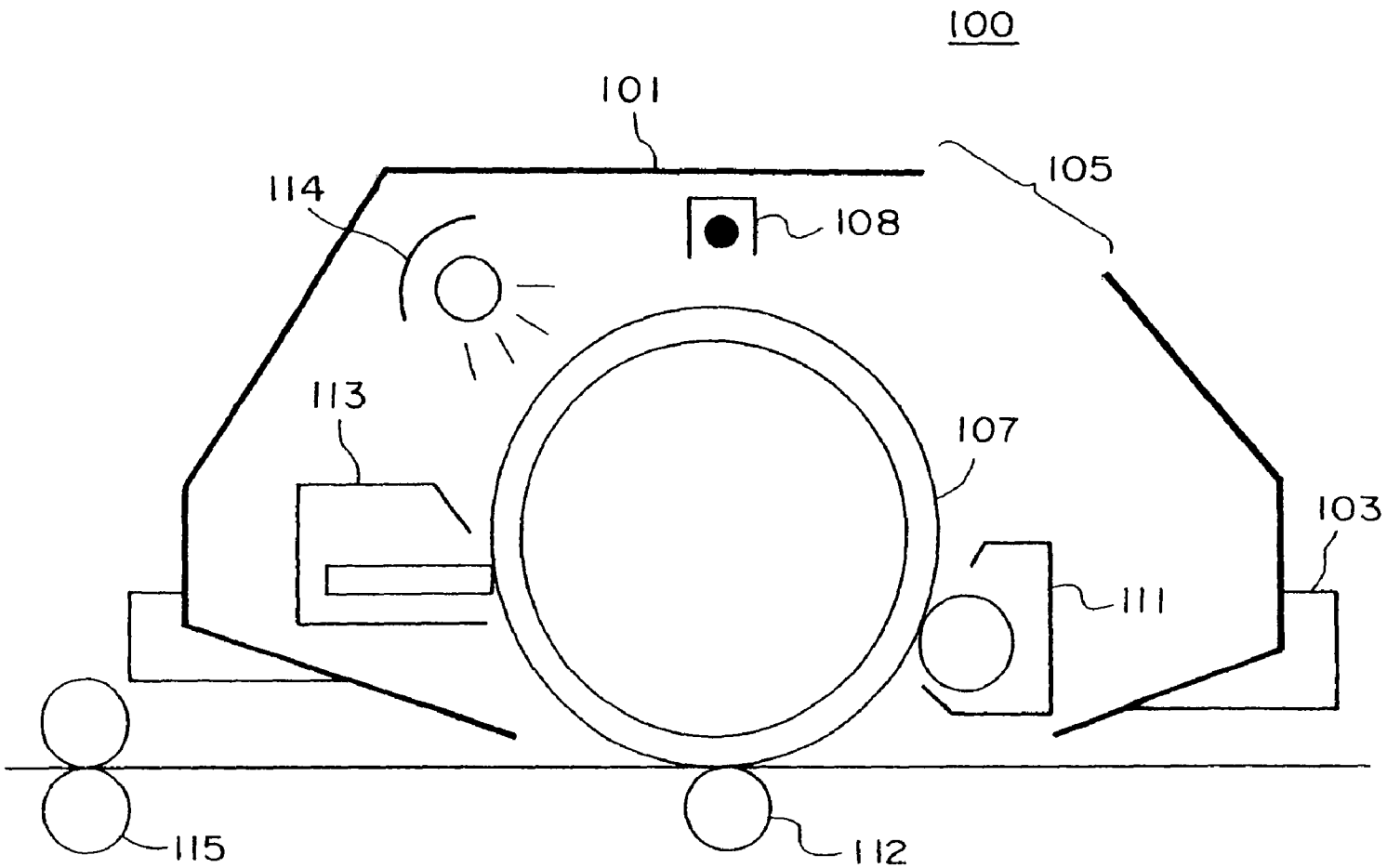
FIG. 6 is a schematic view showing an example of the process cartridge of an exemplary embodiment of the invention.

FIG. 6 is a schematic view of a fundamental structure of a preferable one embodiment of the process cartridge of the invention. The process cartridge 100 is such that acharging device 108, a development device 111, a cleaning device 113, an opening 105 for light exposure, and an antistatic unit 114 together with an electrophotographic photoreceptor 107 are attached, and incorporated by combining them using a case 101 and an attaching rail 103. This process cartridge 100 is detachable with respect to an image forming device body consisting of a transfer device 112, a fixing device 115 and a not shown other component, and constitutes an image forming device in conjunction with an electrophotographic device body.

Figure 7:
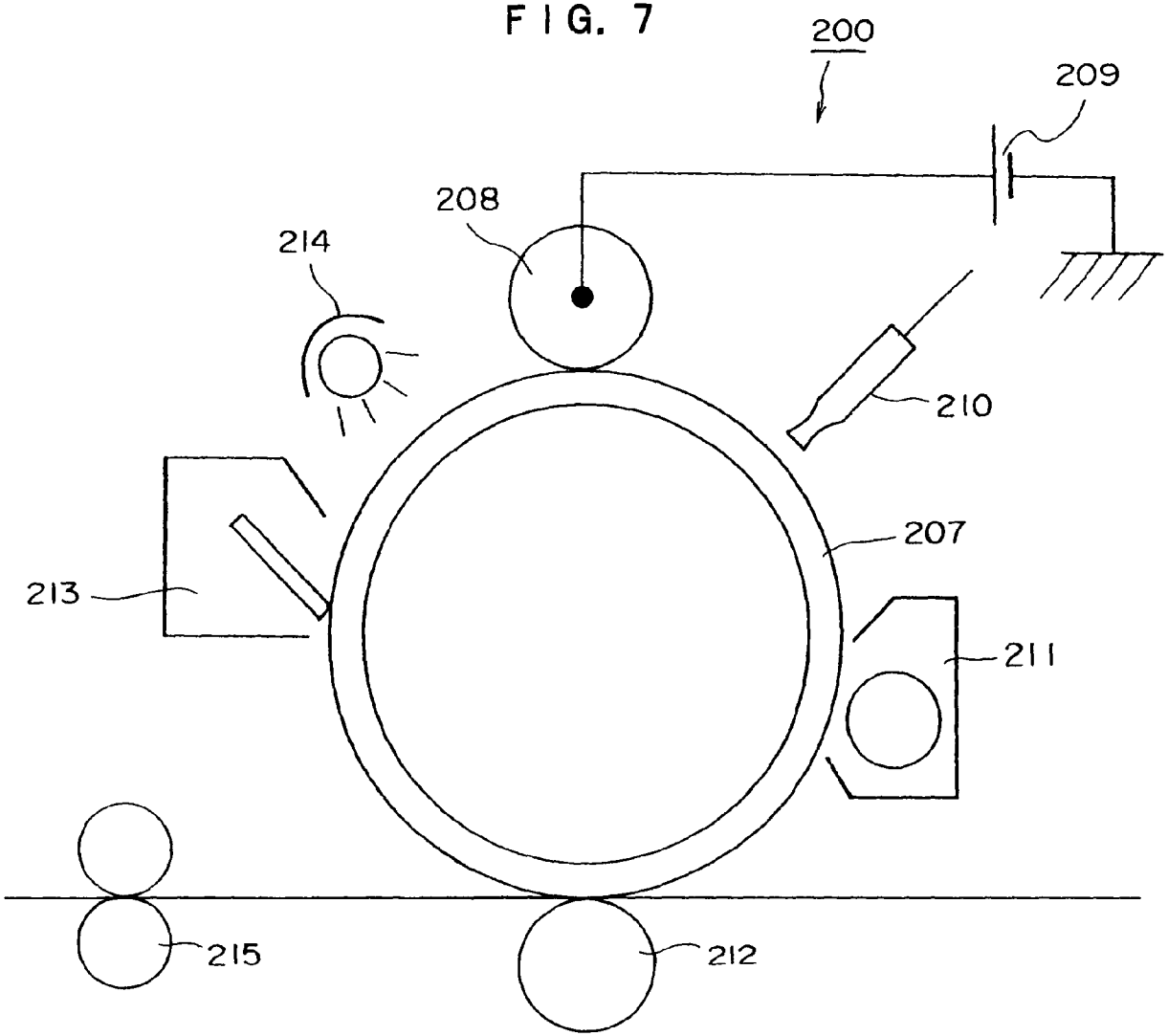
FIG. 7 is a schematic view showing an example of the image forming device of an exemplary embodiment of the invention.

FIG. 7 is a schematic view of a fundamental structure of one embodiment of the image forming device of the invention. The image forming device 200 shown in FIG. 7 is provided with an electrophotographic photoreceptor 207, and a charging device 208 for electrifying the electrophotographic photoreceptor 207 by a contact manner, an electric source 209 connected to the charging device 208, a light exposure device 210 for exposing the electrophotographic photoreceptor which is charged with the charging device 208, a development device 211 for developing a part exposed with the light exposing unit 214, a transfer device 212 for transferring an image developed on the electrophotographic photoreceptor 207 with a development device 211, a cleaning device 213, an antistatic unit 214, and a fixing device 215.

The cleaning device of the process cartridge of an exemplary embodiment of the present invention and the cleaning device of the photoreceptor of the image forming device are not specifically limited. However, the cleaning device is preferably a cleaning blade. Compared to other cleaning devices, the cleaning blade often blemishes the photoreceptor surface and accelerates the wearing. However, since the process cartridge of an exemplary embodiment of the present invention and the image forming device of an exemplary embodiment of the present invention use the photoreceptor of an exemplary embodiment of the present invention as the photoreceptor, blemishes and wearing on the photoreceptor surface may be suppressed even for long term usage.

EXAMPLES

The invention will be specifically explained below by way of Examples, however the invention is not limited by these Examples. In examples and comparative examples, a flow expressed in "sccm" represents a flow under 1 atm (atmosphere pressure; 1,013 hPa) at 0° C.

Example 1

Firstly, in the procedure described below, an organic photoreceptor where on the Al base substance is laminated the under coating layer, the charge generation layer, and the charge transport layer in this order, is produced.

—Formation of Under Coating Layer—

A solution obtained by stirring and mixing 20 weight parts of zirconium compound (trade name: ORGATICS ZC540, made by Matsumoto Chemical Industry Co., Ltd.), 2.5 weight parts of silane compound (trade name: A1100, made by Nippon Unicar Company Limited), 10 weight parts of polyvinyl butyral resin (trade name: S-LEC BM-S made by Sekisui Chemical Co., Ltd.), and 45 weight parts of butanol is coated on the surface of the Al base substance having an outer diameter of 84 mm, and heated and dried at 150° C. for 10 minutes, and thereby the under coating layer having a thickness of 1.0 μm is formed.

—Formation of Charge Generation Layer—

Next, a mixture obtained by mixing 1 weight part of chlorogallium phthalocyanine as the charge generating material, 1 weight part of polyvinyl butyral (trade name: S-LEC BM-S made by Sekisui Chemical Co., Ltd.), and 100 weight parts of n-butylacetate is dispersed with glass beads by a paint shaker for 1 hour, and a charge generation layer forming dispersion is obtained.

This dispersion is applied on the under coating layer by the dip-coating method, and then dried at 100° C. for 10 minutes, to form a charge generation layer having a thickness of 0.15 μm.

—Formation of Charge Transport Layer—

Next, 2 weight parts of the compound represented by the structural formula (1) below and 3 weight parts of the polymeric compound (viscosity-average molecular weight: 39000) represented by the structural formula (2) below are dissolved in 20 weight parts of chlorobenzene, and the charge transport layer forming coating liquid is obtained.

Formula (1)

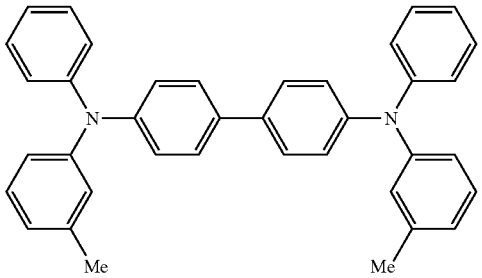

Formula (2)

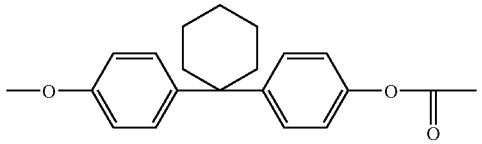

This coating liquid is applied on the charge generation layer by the dip-coating method, and heated at 110° C. for 40 minutes, to form a charge transport layer having a thickness of 20 μm. By so doing, an organic photoreceptor (hereunder, also called a "non-coated photoreceptor") where on the Al base substance is laminated the under coating layer, the charge generation layer, and the charge transport layer in this order, is obtained.

—Formation of Surface Layer—

A surface layer is formed on a surface of a non-coated photoreceptor using a film forming device having a structure shown in FIG. 4.

First, the non-coated photoreceptor is placed on a substrate holder 13 in a film forming chamber 10 of the film forming device, and the film forming chamber 10 is evacuated to a pressure of around 0.1 Pa via an exhaust port 11. Then, a gas obtained by mixing a nitrogen gas, a He gas and an oxygen gas at a ratio of 100:300:0.5 is introduced into a high frequency discharge tube part 21 in which an electrode 19 having a diameter of 50 mm is provided, at 400 sccm, through a gas inlet 20, a radio wave at 13.56 mHz is set at an output of 100 W by high frequency electric supplying part 18 and matching circuit (not shown in FIGS. 4A and 4B), matching is performed with a tuner, and discharge is performed from an electrode 19. Thereupon, a reflection wave is 0 W.

Then, a mixed gas containing a trimethylgallium gas adjusted at 101 kPa at 0° C. using a hydrogen gas as a carrier gas is introduced into a plasma diffusion part 17 in the film forming chamber 10 through a shower nozzle 16 via a gas introducing part 15 at a flow rate of the trimethylgallium mixed gas of 2.5 sccm. Thereupon, a reaction pressure in the film forming chamber 10 measured with a Baratron vacuum gauge (manufactured by MKS Instrument, Inc) is 40 Pa.

In this state, a film is formed for 60 minutes while the non-coated photoreceptor is rotated at a rate of 1 rpm to form a GaO film having a thickness of 0.15 μm, thereby, an organic photoreceptor in which a surface layer is provided on a surface charge transport layer is obtained. Upon film forming, the non-coated photoreceptor is not heat-treated. And, a color of a thermotape (TEMP-PLATE P/N101, manufactured by Wahl) which has been separately applied to a surface of the non-coated photoreceptor in advance under the same condition as that of film forming is confirmed after film forming, and is found to be 40° C.

—Analysis and Evaluation of Surface Layer—

Figure 8:
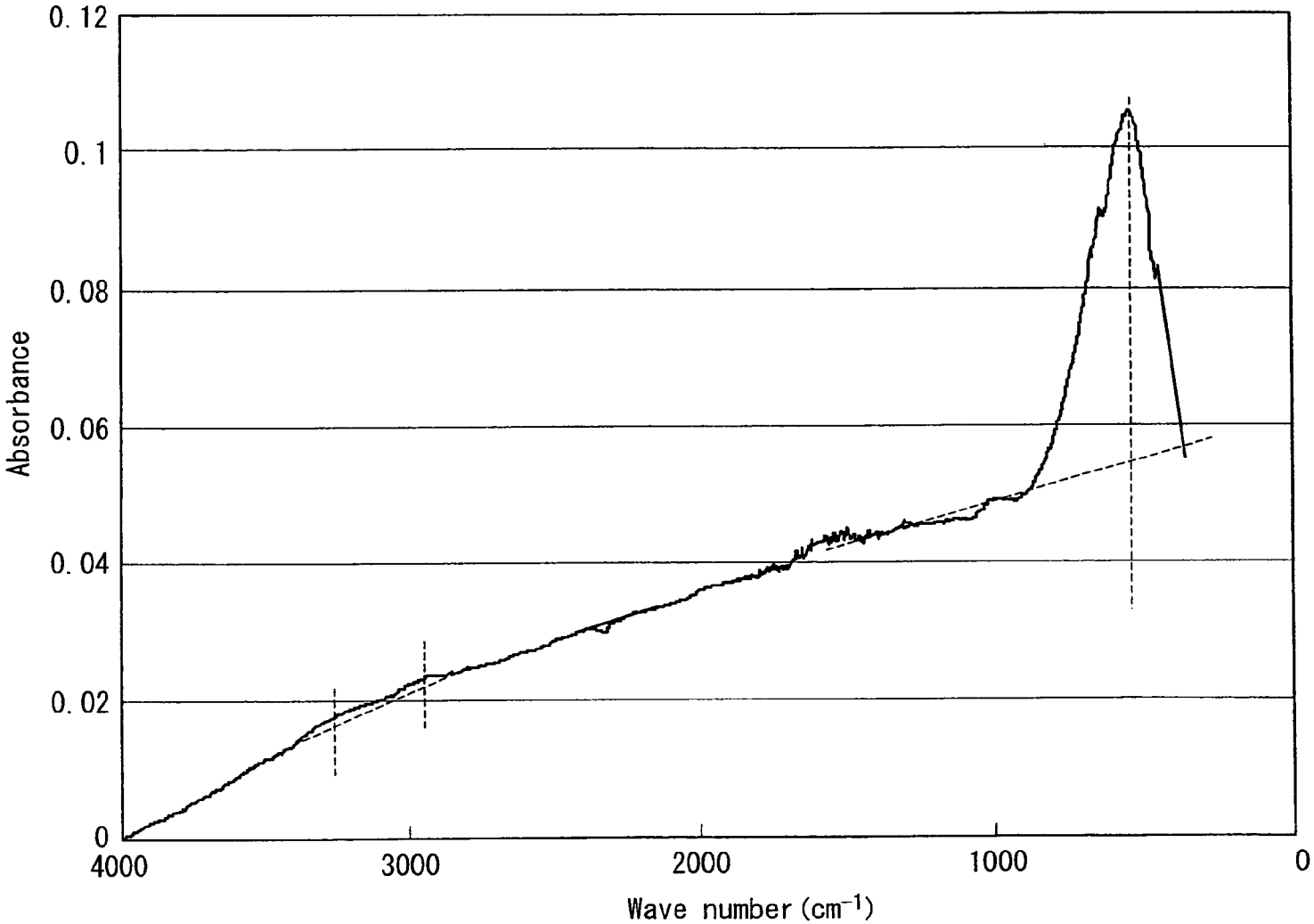
FIG. 8 is a view showing an IR spectrum of a surface layer film prepared in Example 1.

When an infrared absorption spectrum of a film formed on a Si substrate simultaneously upon film forming on a surface of the non-coated photoreceptor is measured and, as shown in FIG. 8, peaks due to a Ga—O bond, an N—H bond and a C—H bond are confirmed. From these, it is found that the surface layer contains gallium, nitrogen, oxygen, hydrogen and carbon. And, respective absorption peak intensity ratios of an N—H bond, a C—H bond and a Ga—H bond with respect to an absorption peak intensity of a Ga—O bond are 0.03, 0.03 and 0.005, respectively, and a full width at half maximum of an absorption peak of a Ga—O bond is 250 $cm^{-1}$.

In a diffraction image obtained by RHEED (reflection high-energy electron diffraction) measurement, a blurred ring is observed in a halo pattern, indicating that a film is a microcrystalline amorphous film. And, even when a film formed on a Si substrate immediately after film forming is immersed in water, a trace does not remain.

—Surface Properties—

Hardness

A hardness is evaluated based on the following criteria by visually observing an extent of occurrence of scratches on a film surface when a piece of Si crystal having a size of 5×10 mm is lightly pressed and rubbed against an approximately 10×10 mm sample film formed on a Si crystal substrate used in the aforementioned composition analysis and rubbed.

A: No occurrence of scratches.

B: When an angle for observing a film surface after rubbing is changed, a scratch-like rubbing trace is observed, but it is of a level which is not practically problematic.

C: A scratch which can be easily confirmed visually is observed on the film surface.

Smoothness

Smoothness is determined by organoleptically evaluating an extent of sliding when a surface of a photoreceptor before being subjected to a printing test is rubbed with a clean tissue (trade name: Bemcot, manufactured by Asahi Kasei Fibers Corporation). Evaluation criteria are as follows.

A: There is no rugged feeling between the Bemcot and a photoreceptor surface, and smoothness is very good.

B: There is a slight rugged feeling between the Bemcot and the photoreceptor surface, but smoothness is fundamentally good.

C: There is a rugged feeling between the Bemcot and the photoreceptor surface, and the Bemcot is torn in some cases.

Initial Moisture Resistance

Initial moisture resistance is evaluated by immersing a sample film formed on a Si substrate, immediately after film forming, in pure water for 10 seconds, pulling out it, and observing the surface state of the film visually. Evaluation criteria are as follows.

A: No change is observed on the surface of the film between before and after immersion in the pure water.

B: A slight change is observed on the surface of the film between before and after immersion in the pure water in some cases, but it is of a level which is difficult to distinguish from a lime deposit.

C: A change is observed on the surface of the film between before and after immersion in the pure water, and a trace of deliquescence of the film surface after immersion is observed.

Contact Angle

A contact angle is measured using a contact angle measuring device CA-X roll type (manufactured by Kyowa Interface Science Co., Ltd.) by dropwise adding pure water to a sample film formed on a Si substrate, after allowing to stand for 24 hours under an environment of 23° C. and 55% RH. The contact angle is repeatedly measured three times at different positions, and an average value is used as the contact angle.

(Evaluation)

Next, the electrophotographic property of this organic photoreceptor provided with a surface layer is evaluated. First, the non-coated photoreceptor before formation of a surface layer, and the photoreceptor provided with a surface layer are irradiated with light for exposure (light source: semiconductor laser, wavelength 780 nm, output 5 mW) while surfaces of the photoreceptors are rotated at 40 rpm and scanned in the state where the surfaces are negatively charged with a Scorotron electrifier at −700 V, and then a remaining potential on a surface is measured. As a result, it is found that, while the potential of the non-coated photoreceptor is −20 V, the potential of the organic photoreceptor provided with the surface layer is −25 V or lower, the temperature and humidity dependency thereof is lower, and the level thereof is better.

In addition, influence on sensitivity is evaluated for light source wavelengths ranging from the infrared region to the entire visible region, and little difference is observed between the non-coated photoreceptor and the photoreceptor provided with the surface layer, whereby it is found that there is no reduction in sensitivity due to provision of the surface layer.

Further, a peeling test in which an applied pressure-sensitive tape is peeled is performed on a surface of the photoreceptor provided with the surface layer, and the surface layer is not peeled at all, whereby it is found that adhering property is good.

Next, this photoreceptor provided with the surface layer is loaded in a DocuCentre Color 500 manufactured by Fuji Xerox Co., Ltd., and a continuous 20000 sheet-printing test is performed under a high temperature and high humidity environment (28° C., 80% RH) to perform the following evaluation. As a reference for performing image quality evaluation, the non-coated photoreceptor is loaded in a DocuCentre Color 500, and the same image is formed.

—Image Blurring—

For evaluating image blurring, after the 20000 sheet-printing test, only a part of a photoreceptor surface is wiped with water in order to remove discharge products which are water-soluble.

Thereafter, a half tone image (image density 30%) is printed, it is determined whether a concentration difference corresponding to the water-wiped portion and the non-water-wiped portion on the photoreceptor surface can be confirmed visually in the half tone image, and when the concentration difference can be easily confirmed at a glance, image blurring is determined to be generated.

—Scratches—

A photoreceptor surface after the printing test is observed visually, and the presence or the absence of scratches on the surface is examined. The above results are summarized in Table 1.

As shown in Table 1, both at a printing test initial stage and after printing test completion, resolution of 10 lines/mm can be obtained in an image having no image blurring at a dot part at the same clearness as that of an image at a printing test initial stage formed using the non-coated photoreceptor. In addition, when a photoreceptor surface after a printing test is observed visually, there is no occurrence of scratches, and abrasion according to film thickness measurement is 0 μm. In contrast, in the non-coated photoreceptor, scratches are generated on a photoreceptor surface after a printing test, and abrasion is 0.3 μm.

Example 2

According to the same manner as that of Example 1 except that formation of a surface layer is performed by changing an amount of a mixed gas of a nitrogen gas, a helium gas and an oxygen gas to be introduced through a gas inlet 20 to about 200 sccm (nitrogen gas 100 sccm, helium gas 100 sccm, oxygen gas 1 sccm), in manufacturing of the electrophotographic photoreceptor of Example 1, a photoreceptor (2) is obtained.

Figure 9:
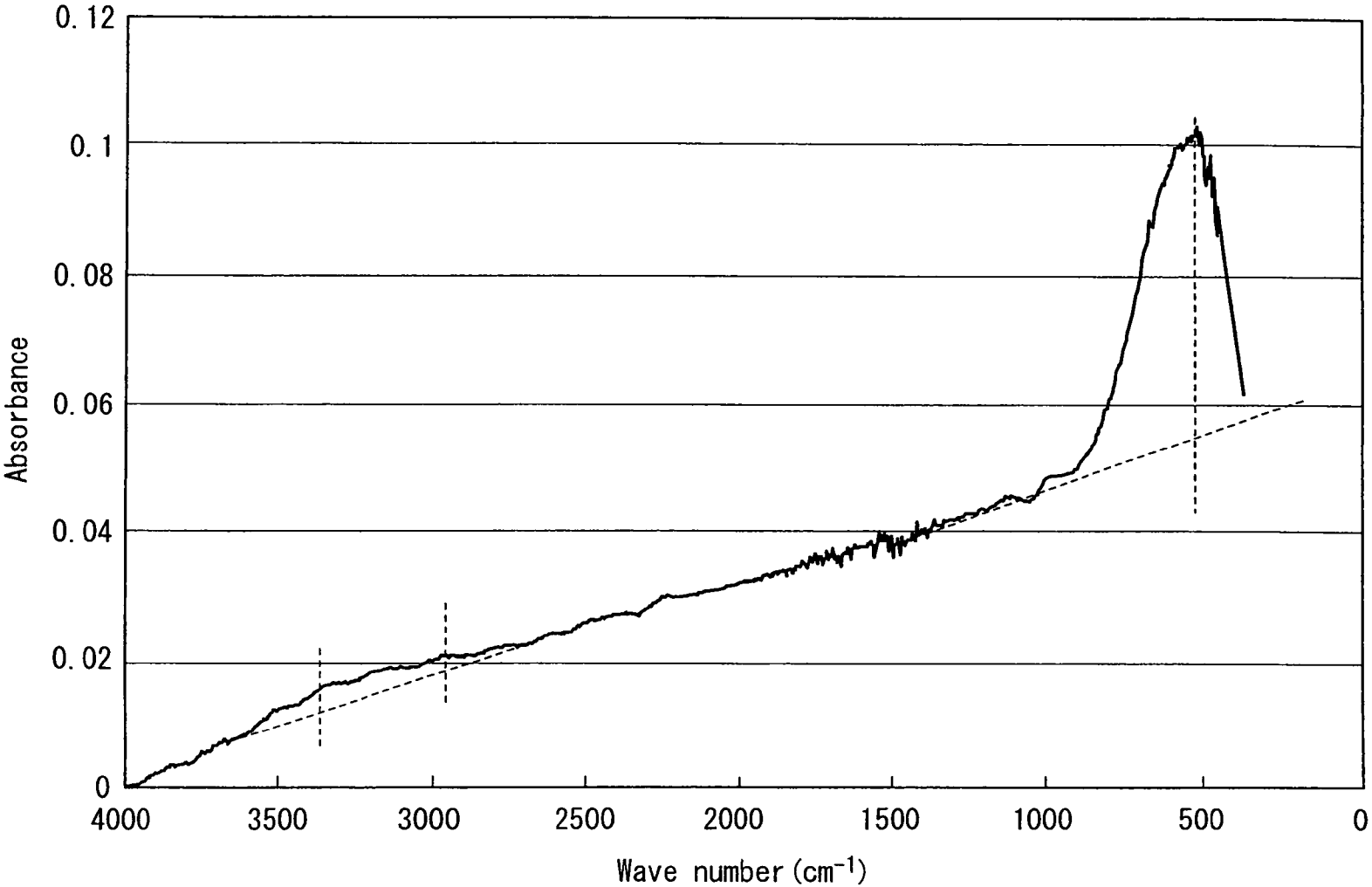
FIG. 9 is a view showing an IR spectrum of a surface layer film prepared in Example 2.

In addition, according to the same manner except that the photoreceptor (2) is used in place of the photoreceptor (1) in evaluation of Example 1, evaluation is performed. An infrared absorption spectrum of a surface layer of the receptor (2) is shown in FIG. 9.

Results including analysis of the surface layer are shown in Table 1.

Example 3

According to the same manner as that of Example 1 except that formation of a surface layer is performed by changing the mixed gas to be introduced through the gas introduced tube 20 to a mixed gas of a nitrogen gas, a helium gas, a hydrogen gas and an oxygen gas, and changing an introduction amount thereof to about 450 sccm (nitrogen gas 100 sccm, helium gas 150 sccm, hydrogen gas 200 sccm, oxygen gas 0.1 sccm), in manufacturing of the electrophotographic photoreceptor of Example 1, a photoreceptor (3) is obtained.

In addition, according to the same manner except that the photoreceptor (3) is used in place of the photoreceptor (1) in evaluation of Example 1, evaluation is performed. An infrared absorption spectrum of the surface layer of the photoreceptor (3) is shown in FIG. 10.

Results including analysis of the surface layer are shown in Table 1.

Example 4

According to the same manner as that of Example 1 except that formation of the surface layer is performed by changing the mixed gas to be introduced through the gas inlet 20 to a mixed gas of a nitrogen gas, a helium gas, a hydrogen gas and an oxygen gas, and changing an introduction amount thereof to about 400 sccm (nitrogen gas 50 sccm, helium gas 150 sccm, hydrogen 200 sccm, oxygen 0.2 sccm), in manufacturing of the electrophotographic photoreceptor of Example 1, a surface layer is formed to obtain a photoreceptor (4).

In addition, according to the same manner except that the photoreceptor (4) is used in place of the photoreceptor (1) in evaluation of Example 1, evaluation is performed.

Results including analysis of the surface layer are shown in Table 1.

Example 5

According to the same manner as that of Example 1 except that formation of the surface layer is performed by changing the mixed gas to be introduced through the gas inlet 20 to a mixed gas of a nitrogen gas, a helium gas, a hydrogen gas and an oxygen gas, and changing an introduction amount thereof to about 350 sccm (nitrogen gas 100 sccm, helium gas 150 sccm, hydrogen 100 sccm, oxygen 2 sccm) in manufacturing of the electrophotographic photoreceptor of Example 1, a surface layer is formed to obtain a photoreceptor (5).

In addition, according to the same manner except that the photoreceptor (5) is used in place of the photoreceptor (1) in evaluation of Example 1, evaluation is performed.

Results including analysis of the surface layer are shown in Table 1.

Example 6

According to the same manner as that of Example 1 except that formation of the surface layer is performed by changing the mixed gas to be introduced through the gas inlet 20 to a mixed gas of a nitrogen gas, a helium gas, a hydrogen gas, and an oxygen gas, and changing an introduction amount thereof to about 750 sccm (nitrogen gas 50 sccm, helium gas 100 sccm, hydrogen gas 600 sccm, oxygen gas 0.05 sccm), and using a trimethylaluminum gas in place of the trimethylgallium gas in manufacturing of the electrophotographic photoreceptor of Example 1, a photoreceptor (6) is obtained.

Figure 11:
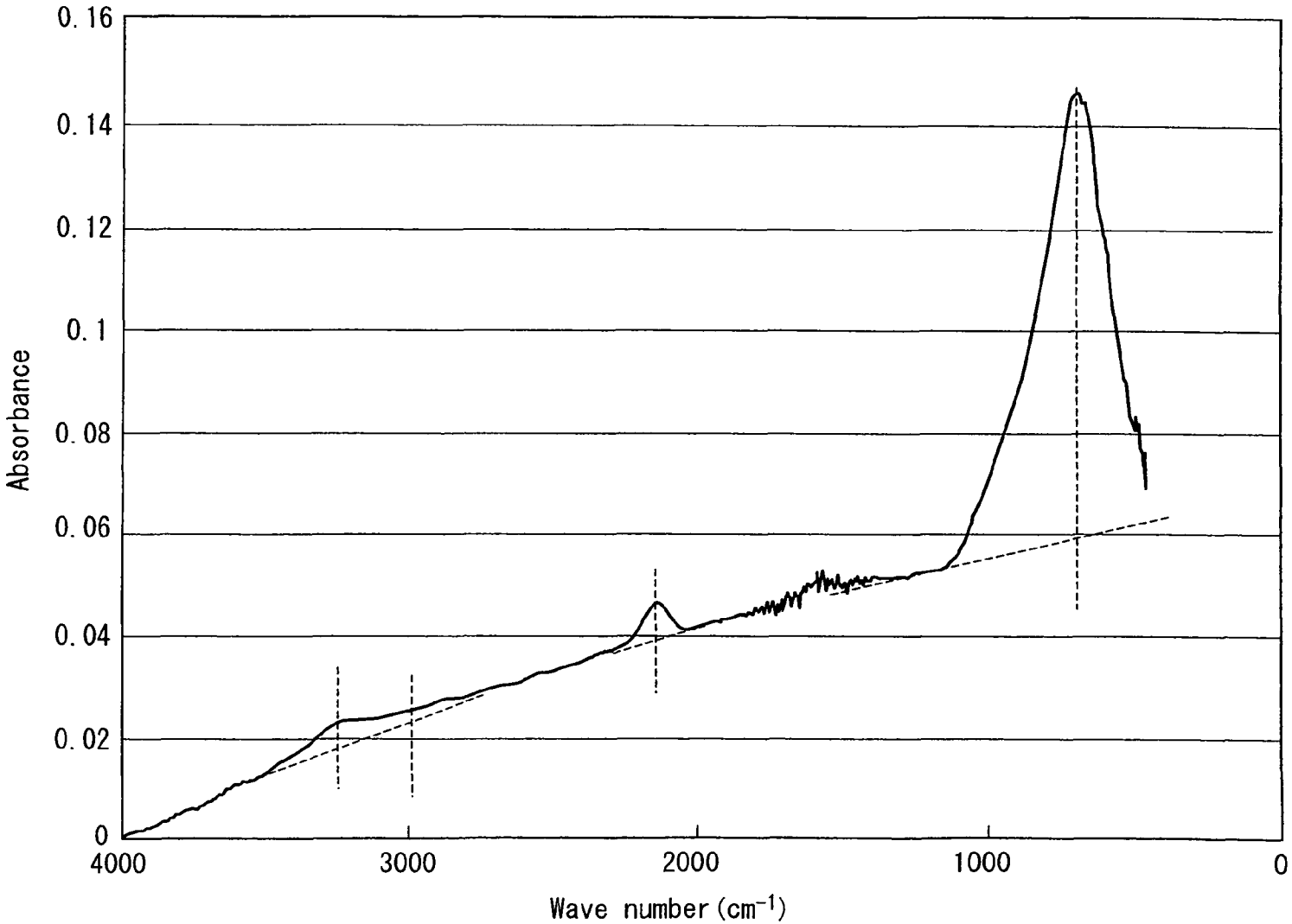
FIG. 11 is a view showing an IR spectrum of a surface layer film prepared in Example 6.

In addition, according to the same manner except that the photoreceptor (6) is used in place of the photoreceptor (1) in evaluation of Example 1, evaluation is performed. An infrared spectrum of the surface layer of the photoreceptor (6) is shown in FIG. 11.

Results including analysis of the surface layer are shown in Table 1.

Example 7

According to the same manner as that of Example 1 except that formation of the surface layer is performed by changing the mixed gas to be introduced through the gas inlet 20 to a mixed gas of a nitrogen gas, a hydrogen gas, and an oxygen gas, and changing an introduction amount thereof to about 600 sccm (nitrogen gas 100 sccm, hydrogen gas 500 sccm, oxygen gas 0.05 sccm), and using a trimethylaluminum gas in place of the trimethylgallium gas in manufacturing of the electrophotographic photoreceptor of Example 1, a photoreceptor 7 is obtained.

In addition, according to the same manner except that the photoreceptor 7 is used in place of the photoreceptor (1) in evaluation of Example 1, evaluation is performed.

Results including analysis of the surface layer are shown in Table 1.

Example 8

A cylindrical substrate composed of Al having a thickness of 3 mm is amounted in a plasma CVD device for a cylindrical substrate, and a charge injection arresting layer having a film thickness of 3 μm composed of n-type $SiN_{0.5}$, an i-type amorphous silicon photosensitive layer having a film thickness of 20 μm, and a charge injection arresting surface layer having a film thickness of 0.5 μm composed of p-type $Si_2C$ are laminated in this order to obtain a negative charging-type amorphous silicon photoreceptor. Using the device having the same structure as that of Example 1 shown in FIG. 4, a surface layer is formed on this surface under the same condition as that of Example 1 to obtain an amorphous silicon photoreceptor (8) having a surface layer.

In addition, according to the same manner except that the photoreceptor (8) is used in place of the photoreceptor (1), and a surface potential is set at −400 V to adjust a light exposure amount in evaluation of Example 1, evaluation is performed.

Results including analysis of the surface layer are shown in Table 1.

Example 9

In manufacturing of the electrophotographic photoreceptor of Example 1, a GaON:H film having a thickness of 0.1 μm is prepared as an intermediate layer under the same condition as that of Example 3 before formation of the surface layer.

Then, a GaNO:H film having a thickness of 0.1 μm is prepared under the same condition as that of Example 5 to obtain a photoreceptor (9).

In addition, according to the same manner except that the photoreceptor (9) is used in place of the photoreceptor (8) in evaluation of Example 8, evaluation is performed.

Results including analysis of the surface layer are shown in Table 1.

Comparative Example 1

According to the same manner as that of Example 1 except that formation of the surface layer is performed by changing the mixed gas to be introduced through the gas inlet 20 to a mixed gas of a nitrogen gas, a hydrogen gas and an oxygen gas, and changing an introduction amount thereof to about 700 sccm (nitrogen gas 500 sccm, hydrogen 200 sccm, oxygen 0.05 sccm) in manufacturing of the electrophotographic photoreceptor of Example 1, a surface layer is formed to obtain a photoreceptor (10).

Figure 12:
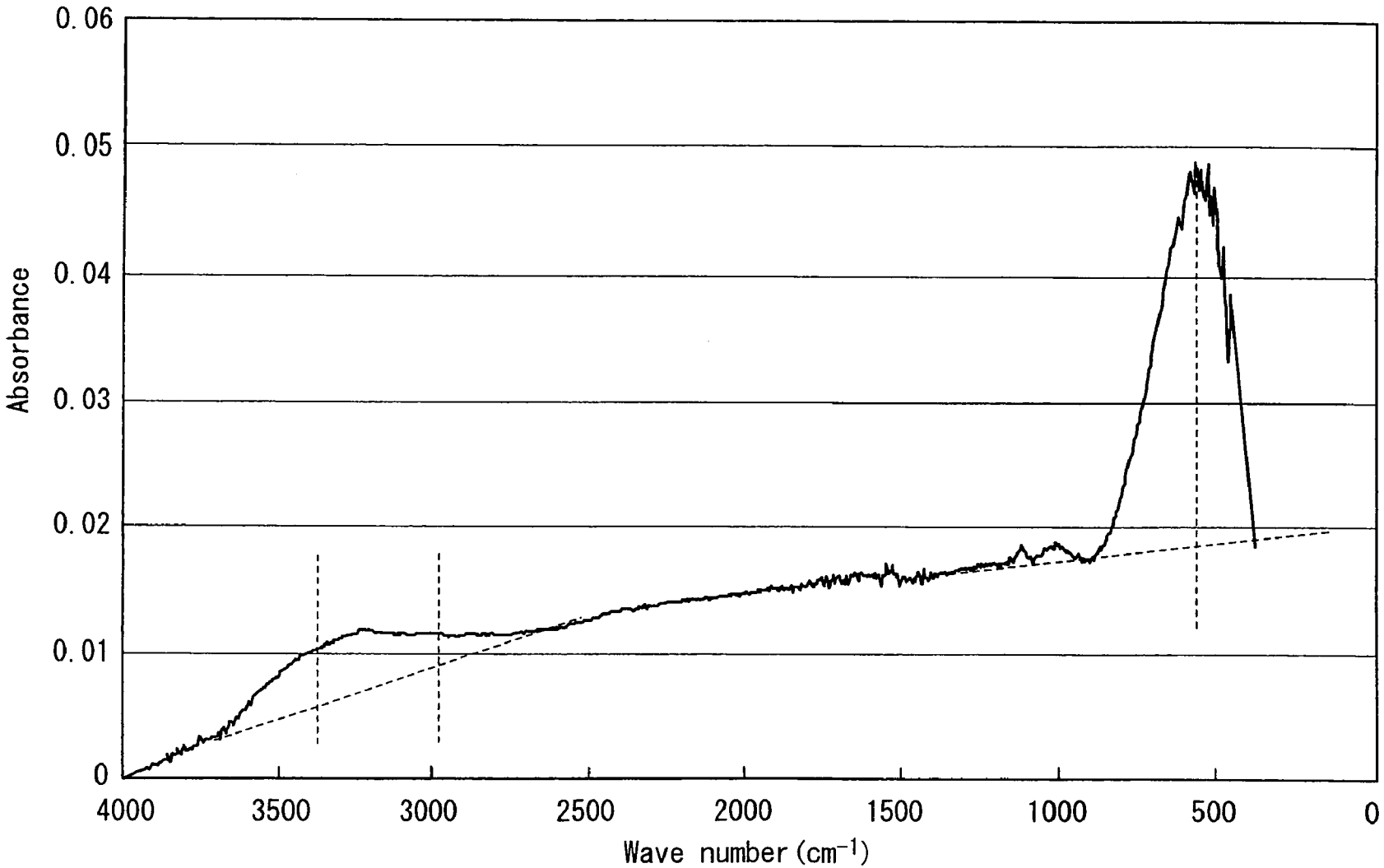
FIG. 12 is a view showing an IR spectrum of a surface layer film prepared in Comparative Example 1.

In addition, according to the same manner except that the photoreceptor (10) is used in place of the photoreceptor (1) in evaluation of Example 1, evaluation is performed. An infrared absorption spectrum of the surface layer of the photoreceptor (10) is shown in FIG. 12.

Results including analysis of the surface layer are shown in Table 1.

Comparative Example 2

According to the same manner as that of Example 1 except that formation of the surface layer is performed by changing the mixed gas to be introduced through the gas inlet 20 to a mixed gas of a nitrogen gas, a hydrogen gas and an oxygen gas, and changing an introduction amount thereof to about 600 sccm (nitrogen gas 100 sccm, hydrogen 500 sccm, oxygen 0.5 sccm), and using a trimethylaluminum gas in place of the trimethylgallium gas, in manufacturing of the electrophotographic photoreceptor of Example 1, a photoreceptor (11) is obtained.

Figure 13:
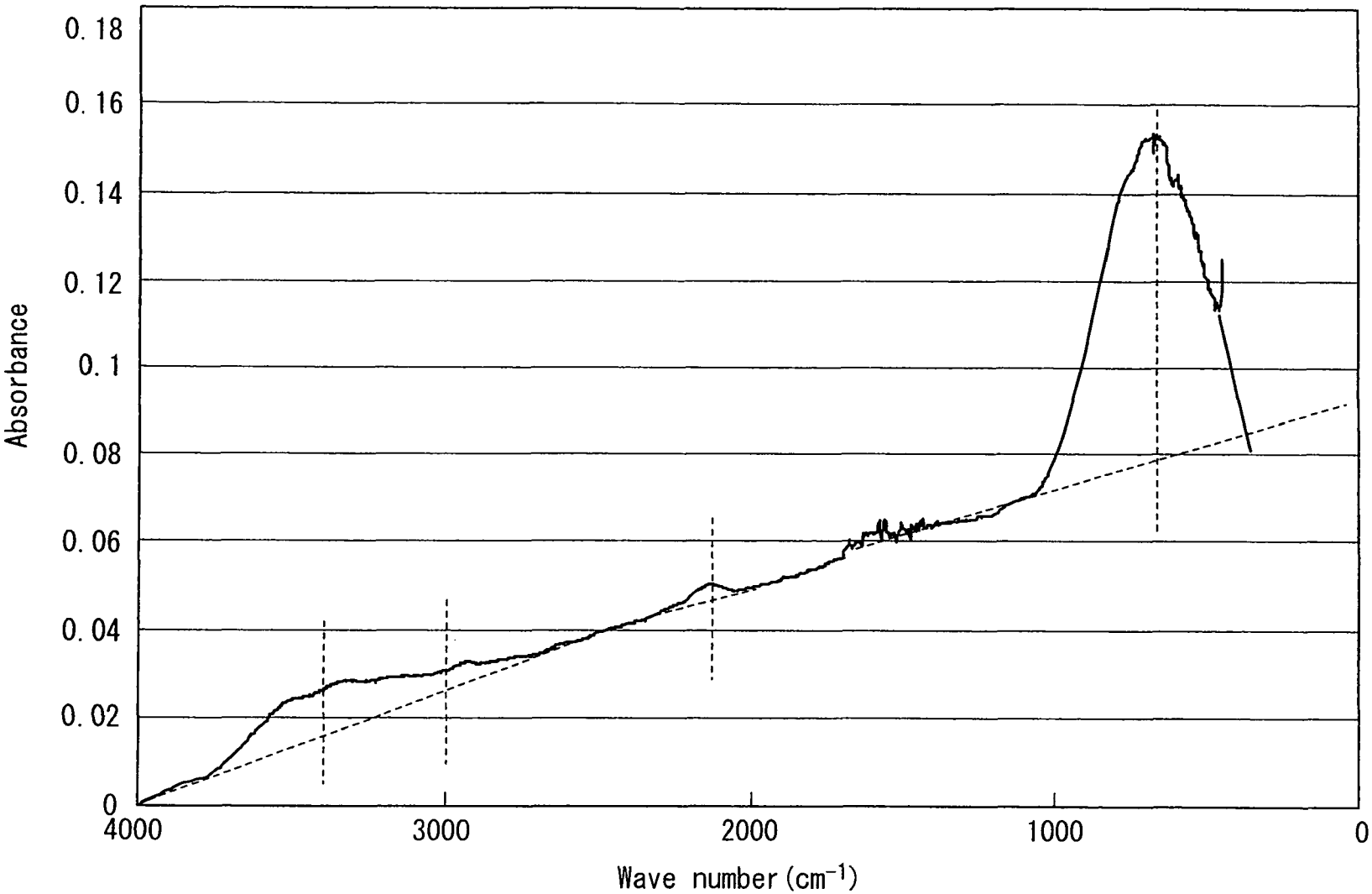
FIG. 13 is a view showing an IR spectrum of a surface layer film prepared in Comparative Example 2.

In addition, according to the same manner except that the photoreceptor (11) is used in place of the photoreceptor (1) in evaluation of Example 1, evaluation is performed. An infrared absorption spectrum of the surface layer of the photoreceptor (11) is shown in FIG. 13.

Results including analysis of the surface layer are shown in Table 1.

TABLE 1

| | | Example 1 | Example 2 | Example 3 | Example 4 | Example 5 | Example 6 | Example 7 | Example 8 | Example 9 | Comparative Example 1 | Comparative Example 2 |
|---|---|---|---|---|---|---|---|---|---|---|---|---|
| Photoreceptor No. | | (1) | (2) | (3) | (4) | (5) | (6) | (7) | (8) | (9) | (10) | (11) |
| Absorption peak intensity ratio | NH/GaO | 0.03 | 0.08 | 0.05 | 0.02 | 0.01 | — | — | — | — | 0.17 | — |
| | CH/GaO | 0.03 | 0.05 | 0.04 | 0.001 | 0.001 | — | — | — | — | 0.10 | — |
| | GaH/GaO | 0.005 | 0 | 0.03 | 0 | 0 | — | — | — | — | 0 | — |
| | NH/AlO | — | — | — | — | — | 0.07 | 0.03 | 0.02 | 0.01 | — | 0.14 |
| | CH/AlO | — | — | — | — | — | 0.04 | 0.005 | 0.02 | 0.001 | — | 0.05 |
| | AlH/AlO | — | — | — | — | — | 0.07 | 0.06 | 0.005 | 0 | — | 0.05 |
| Full width at half maximum of a GaO (AlO) absorption peak ($cm^{-1}$) | | 250 | 300 | 250 | 230 | 280 | 240 | 280 | 250 | 280 | 240 | 375 |
| Surface layer thickness (μm) | | 0.15 | 0.20 | 0.20 | 0.15 | 0.20 | 0.20 | 0.20 | 0.15 | 0.10 | 0.20 | 0.20 |
| Surface property | Hardness | A | A | A | A | A | A | A | A | A | A | A |
| | Smoothness | B | B | A | A | A | A | A | B | A | B | B |
| | Initial moisture resistance | A | A | A | A | A | A | A | A | A | C | A |
| | Contact angle (°) | 90 | 90 | 91 | 90 | 93 | 89 | 90 | 91 | 93 | 90 | 90 |
| Actual machine property | Image blurring (at 20000) | None | None | None | None | None | None | None | None | None | Occurrence | Occurrence |
| | Scratch occurrence (at 20000) | None | None | None | None | None | None | None | None | None | None | None |

As shown in Table 1, it is shown that in photoreceptors of Examples having an IR spectrum absorption intensity ratio of 0.1 or less, image quality reduction such as image blurring is not generated even in repetitive printing output under the high temperature high humidity atmosphere as compared with photoreceptors of Comparative Examples having an absorption intensity ratio exceeding 0.1.

All publications, patent applications, and technical standards mentioned in this specification are herein incorporated by reference to the same extent as if each individual publication, patent application, or technical standard was specifically and individually indicated to be incorporated by reference.

What is claimed is:

1. An electrographic photoreceptor comprising a surface layer, a photosensitive layer comprising an organic photosensitive material, and a conductive substrate laminated in this order, wherein the photosensitive layer comprises a charge generation layer and a charge transport layer, the surface layer comprises a group 13 element and oxygen, and absorption peak intensities showing bonds other than a bond between the group 13 element and oxygen are 0.1 times or less of an absorption peak intensity showing a bond between the group 13 element and oxygen in an infrared absorption spectrum of the surface layer in a range of 4000 $cm^{-1}$ to 400 $cm^{-1}$.

2. The electrographic photoreceptor of claim 1, wherein the absorption peak intensities showing bonds other than a bond between the group 13 element and oxygen are 0.08 times or less of an absorption peak intensity showing a bond between the group 13 element and oxygen.

3. The electrographic photoreceptor of claim 1, wherein the absorption peak intensities showing bonds other than a bond between the group 13 element and oxygen are 0.05 times or less of an absorption peak intensity showing a bond between the group 13 element and oxygen.

4. The electrographic photoreceptor of claim 1, wherein the group 13 element included in the surface layer is gallium or aluminum.

5. The electrographic photoreceptor of claim 1, wherein the surface layer comprises hydrogen.

6. The electrographic photoreceptor of claim 1, wherein the surface layer comprises oxygen in an amount of more than 15 atomic %.

7. The electrographic photoreceptor of claim 1, wherein the surface layer comprises oxygen in an amount of 28 atomic % or more.

8. The electrographic photoreceptor of claim 1, wherein an intermediate layer is provided between the photosensitive layer and the surface layer.

9. A process cartridge integrally comprising:

an electrographic photoreceptor comprising a surface layer, a photosensitive layer comprising an organic photosensitive material, and a conductive substrate laminated in this order; and at least one selected from a charging device, a development device or a cleaning device, wherein:

the photosensitive layer comprises a charge generation layer and a charge transport layer, and the surface layer comprises a group 13 element and oxygen, and absorption peak intensities showing bonds other than a bond between the group 13 element and oxygen are 0.1 times or less of an absorption peak intensity showing a bond between the group 13 element and oxygen in an infrared absorption spectrum of the surface layer in a range of 4000 $cm^{-1}$ to 400 $cm^{-1}$.

10. The process cartridge of claim 9, wherein the absorption peak intensities showing bonds other than a bond between the group 13 element and oxygen are 0.08 times or less of an absorption peak intensity showing a bond between the group 13 element and oxygen.

11. The process cartridge of claim 9, wherein the absorption peak intensities showing bonds other than a bond between the group 13 element and oxygen are 0.05 times or less of an absorption peak intensity showing a bond between the group 13 element and oxygen.

12. An image forming device comprising:

an electrographic photoreceptor comprising a surface layer, a photosensitive layer comprising an organic photosensitive material, and a conductive substrate laminated in this order;

a charging device for charging a surface of the electrographic photoreceptor;

an electrostatic latent image forming device for forming an electrostatic latent image on the charged electrographic photoreceptor;

a development device for developing the electrostatic latent image as a toner image with a developer comprising a toner; and a transfer device for transferring the toner image onto a recording medium, wherein:

the photosensitive layer comprises a charge generation layer and a charge transport layer, and the surface layer comprises a group 13 element and oxygen, and absorption peak intensities showing bonds other than a bond between the group 13 element and oxygen are 0.1 times or less of an absorption peak intensity showing a bond between the group 13 element and oxygen in an infrared absorption spectrum of the surface layer in a range of 4000 $cm^{-1}$ to 400 $cm^{-1}$.

13. The image forming device of claim 12, wherein the absorption peak intensities showing bonds other than a bond between the group 13 element and oxygen are 0.08 times or less of an absorption peak intensity showing a bond between the group 13 element and oxygen.

14. The image forming device of claim 12, wherein the absorption peak intensities showing bonds other than a bond between the group 13 element and oxygen are 0.05 times or less of an absorption peak intensity showing a bond between the group 13 element and oxygen.

15. The electrographic photoreceptor of claim 1, the surface layer further comprising one or more of:

hydrogen in a range of 0.1 atomic % to 30 atomic %;

nitrogen in a ratio range of 1.0:0.5 to 1.0:2.0 of a sum of atom number of a group 13 element and atom number of nitrogen; and carbon of 15 atomic % or less.

* * * * *